US012631198B2

(12) United States Patent
Chiu et al.

(10) Patent No.: US 12,631,198 B2
(45) Date of Patent: May 19, 2026

(54) DIAGONAL FAN

(71) Applicant: Delta Electronics, Inc., Taoyuan City (TW)

(72) Inventors: Pei-Han Chiu, Taoyuan City (TW); Sheng-Chieh Su, Taoyuan City (TW); Chien-Ming Lee, Taoyuan City (TW)

(73) Assignee: Delta Electronics, Inc., Taoyuan City (TW)

( * ) Notice: Subject to any disclaimer, the term of this patent is extended or adjusted under 35 U.S.C. 154(b) by 0 days.

(21) Appl. No.: 18/796,221

(22) Filed: Aug. 6, 2024

(65) Prior Publication Data

US 2024/0392808 A1 Nov. 28, 2024

Related U.S. Application Data

(63) Continuation-in-part of application No. 17/680,052, filed on Feb. 24, 2022, now abandoned.

(60) Provisional application No. 63/153,868, filed on Jul. 29, 2021.

(30) Foreign Application Priority Data

Feb. 11, 2022 (CN) ..... 202210128548.9

(51) Int. Cl.
*F04D 29/66* (2006.01)
*F04D 29/32* (2006.01)

(52) U.S. Cl.
CPC ..... *F04D 29/667* (2013.01); *F04D 29/325* (2013.01)

(58) Field of Classification Search
CPC .... F04D 29/326; F04D 29/325; F04D 29/667; F04D 17/06; F04D 29/009; F04D 29/0207; F04D 27/009; F04D 27/0207
See application file for complete search history.

(56) References Cited

U.S. PATENT DOCUMENTS 3,303,995 A 2/1967 Boeckel
4,566,852 A 1/1986 Hauser
5,352,089 A 10/1994 Tokunaga et al.
(Continued)

FOREIGN PATENT DOCUMENTS

CN 100374734 C 3/2008
CN 101218435 A 7/2008
(Continued)

OTHER PUBLICATIONS

Parallel Curves. Sep. 12, 2025. https://en.wikipedia.org/wiki/Parallel_curve.

*Primary Examiner* — Michael K. Reitz
(74) *Attorney, Agent, or Firm* — KIRTON McCONKIE; Evan R. Witt

(57) ABSTRACT

A diagonal fan is disclosed and includes a frame and an impeller. The frame includes an inlet, an outlet, and an accommodation space. The inlet and the outlet are communicated through the accommodation space. The impeller is accommodated within the accommodation space and includes a hub, a cylindrical part, a conical section shell and a plurality of blades, wherein the cylindrical part is configured to accommodate a rotor. The cylindrical part includes a plurality of protrusion portions and a plurality of indentation portions disposed on an inner surface thereof, and the plurality of protrusion portions are abutted against an outer surface of a magnetic shell of the rotor.

13 Claims, 28 Drawing Sheets

(56) References Cited

U.S. PATENT DOCUMENTS

| | | | | |
|---|---|---|---|---|
| 5,695,318 | A * | 12/1997 | Harmsen | F04D 17/06 415/218.1 |
| 5,743,710 | A | 4/1998 | Yapp | |
| 5,813,831 | A | 9/1998 | Matsunaga et al. | |
| 6,830,440 | B1 | 12/2004 | Riddoch | |
| 8,029,251 | B2 * | 10/2011 | Oguma | F04D 25/0613 417/354 |
| 9,103,347 | B2 | 8/2015 | Yu | |
| 9,404,502 | B2 | 8/2016 | Ishikawa | |
| 10,711,992 | B2 | 7/2020 | Fan | |
| 11,092,162 | B2 | 8/2021 | Ishii et al. | |
| 11,732,728 | B2 | 8/2023 | Gebert et al. | |
| 2010/0111667 | A1 | 5/2010 | Stagg et al. | |
| 2012/0020778 | A1 | 1/2012 | Ruck | |
| 2012/0219419 | A1 | 8/2012 | Liu | |
| 2013/0149122 | A1 | 6/2013 | Yeh et al. | |
| 2013/0236303 | A1 | 9/2013 | Teramoto et al. | |
| 2013/0323096 | A1 | 12/2013 | Mueller et al. | |
| 2015/0176594 | A1 | 6/2015 | Gebert et al. | |
| 2016/0245306 | A1 | 8/2016 | Berroth et al. | |
| 2016/0290358 | A1 | 10/2016 | Hayamitsu et al. | |
| 2018/0242800 | A1 | 8/2018 | Hayamitsu et al. | |
| 2018/0245601 | A1 | 8/2018 | Hayamitsu et al. | |
| 2019/0101122 | A1 | 4/2019 | Gebert | |
| 2019/0107112 | A1 | 4/2019 | Chang et al. | |
| 2020/0124051 | A1 | 4/2020 | Chang et al. | |
| 2021/0277910 | A1 | 9/2021 | Heli et al. | |
| 2021/0278097 | A1 | 9/2021 | Min et al. | |
| 2022/0003243 | A1 | 1/2022 | Imahigashi et al. | |
| 2022/0023788 | A1 | 1/2022 | Oh et al. | |
| 2022/0049714 | A1 | 2/2022 | Haaf et al. | |
| 2022/0065256 | A1 | 3/2022 | Sishtla et al. | |
| 2023/0066531 | A1 | 3/2023 | Kim et al. | |

FOREIGN PATENT DOCUMENTS

| | | | |
|---|---|---|---|
| CN | 100594304 | C | 3/2010 |
| CN | 101307769 | B | 4/2013 |
| CN | 108350899 | A | 7/2018 |
| CN | 111089069 | A | 5/2020 |
| CN | 111379724 | A | 7/2020 |
| CN | 111433463 | A | 7/2020 |
| TW | 201033478 | A | 9/2010 |
| TW | M413157 | U | 10/2011 |
| TW | I633260 | B | 8/2018 |

* cited by examiner

1

DIAGONAL FAN

CROSS-REFERENCE TO RELATED APPLICATION

This application is a continuation-in-part application of U.S. application Ser. No. 17/680,052 filed on Feb. 24, 2022 and entitled "DIAGONAL FAN", which claims the benefit of U.S. Provisional Application No. 63/153,868 filed on Jul. 29, 2021 and entitled "DIAGONAL FAN", and also claims priority to China Patent Application No. 202210128548.9 filed on Feb. 11, 2022. The entireties of the above-mentioned patent applications are incorporated herein by reference for all purposes.

FIELD OF THE INVENTION

The present disclosure relates to a diagonal fan, and more particularly to a diagonal fan having an optimized chamber to reduce the backflow flowing into the chamber and eliminate the turbulence area in the chamber and an improved impeller, thereby achieving the purpose of improving the fan characteristics and reducing the noise.

BACKGROUND OF THE INVENTION

With the increasing amount of calculation and transmission required by the communication systems, the efficiency and power consumption of electronic components in the system need to be improved to cope with huge data calculations continuously. In order to maintain the normal operation of the equipment, it is necessary to remove the internal heat of the system effectively. In a conventional communication equipment on the current market, the fan is mainly used to perform the forced convection on the system to achieve the purpose of heat dissipation. However, under increasingly severe system conditions, how to improve the efficiency of the fan effectively and maintain the same noise level has always been the goal of the industry's efforts.

Therefore, there is a need of providing a diagonal fan having an optimized chamber to reduce the backflow flowing into the chamber and eliminate the turbulence area in the chamber and an improved impeller, thereby achieving the purpose of improving the fan characteristics and reducing the noise, so as to obviate the drawbacks encountered by the prior arts.

SUMMARY OF THE INVENTION

An object of the present disclosure is to provide a diagonal fan having an optimized chamber to reduce the backflow flowing into the chamber and eliminate the turbulence area in the chamber and an improved impeller, thereby achieving the purpose of improving the fan characteristics and reducing the noise.

Another object of the present disclosure is to provide a diagonal fan. The outer diameter of the hub of the impeller is expended gradually in a direction from the inlet toward the outlet so that the flowing direction of the airflow is expended gradually around a periphery of the impeller, thereby forming the main feature of the diagonal fan. The guiding wall disposed on the frame is staggered and overlapped with the upper end of the conical section shell of the impeller, the inlet diameter is less than the outlet diameter, and the upper end of the conical section shell is extended upwardly from the tips of the blades, so that the diagonal fan is allowed to achieve the characteristic of slowing down the stall region as a centrifugal fan. The inner wall surface of the frame and the outer wall and the upper end of the conical section shell are designed to be parallel to each other, and a spacing distance is substantially maintained between the inner wall surface of the frame, and the outer wall and the upper end of the conical section shell to form a backflow channel, so that as a backflow is sucked into the backflow channel through an intake section, the flow velocity and the kinetic energy of the flow field are reduced gradually. Therefore, the wind resistance between the inner wall surface of the frame, and the outer wall and the upper end of the conical section shell is increased, the backflow sucked into the backflow channel is reduced, and the turbulent flow intensity of the backflow channel is eliminated simultaneously. Furthermore, the balance holes on the impeller are arranged and corresponding to the horizontal section of the backflow channel. On the other hand, when the impeller is rotated, the backflow flows in the exhaust section along a direction identical to that of the airflow flowing. In this way, when the backflow is converged into the airflow, the collision of flowing field is less likely to occur.

Another object of the present disclosure is to provide a diagonal fan having protrusion portions and indentation portions disposed on an inner surface of the cylindrical part of the impeller thereof, thereby facilitating the balance of the diagonal fan.

Another object of the present disclosure is to provide a diagonal fan having recesses disposed on the hub of the impeller thereof for being further assisting the balance of the diagonal fan.

In accordance with an aspect of the present disclosure, a diagonal fan is provided and includes a frame and an impeller. The frame includes an inlet, an outlet, an accommodation space and a guiding wall. The inlet and the outlet are disposed at two opposite sides of the frame, and in fluid communication with each other through the accommodation space. The impeller is accommodated within the accommodation space of the frame. When the impeller is rotated, an airflow flowing from the inlet to the outlet is generated. The outer diameter of a hub of the impeller is expended gradually in a direction from the inlet toward the outlet so that the flowing direction of the airflow is expended gradually around a periphery of the impeller. The impeller includes a conical section shell, and a spacing distance is substantially maintained between the inner wall surface of the frame, and an outer wall and an upper end of the conical section shell to form a backflow channel. The backflow channel includes an intake section, a horizontal section and an exhaust section, the intake section is located adjacent to a lower end of the conical section shell and in fluid communication with the exhaust section through the horizontal section, and the upper end of the conical section shell is at least partially shielded by the guiding wall to form the exhaust section. When the airflow flows from the inlet to the outlet, a backflow is transported from the intake section, flows through the horizontal section, is exhausted out through the exhaust section, and is converged with the airflow.

In accordance with another aspect of the present disclosure, a diagonal fan is provided and includes a frame and an impeller. The frame includes an inlet, an outlet and an accommodation space. The inlet and the outlet are disposed at two opposite sides of the frame, and in fluid communication with each other through the accommodation space. The impeller is accommodated within the accommodation space of the frame. The impeller includes a hub, a cylindrical part, a conical section shell and a plurality of blades, wherein the cylindrical part is configured to accommodate a rotor.

The cylindrical part includes a plurality of protrusion portions and a plurality of indentation portions disposed on an inner surface thereof, and the plurality of protrusion portions are abutted against an outer surface of a magnetic shell of the rotor.

BRIEF DESCRIPTION OF THE DRAWINGS

The above contents of the present disclosure will become more readily apparent to those ordinarily skilled in the art after reviewing the following detailed description and accompanying drawings, in which.

DETAILED DESCRIPTION OF THE PREFERRED EMBODIMENT

Figure 1:
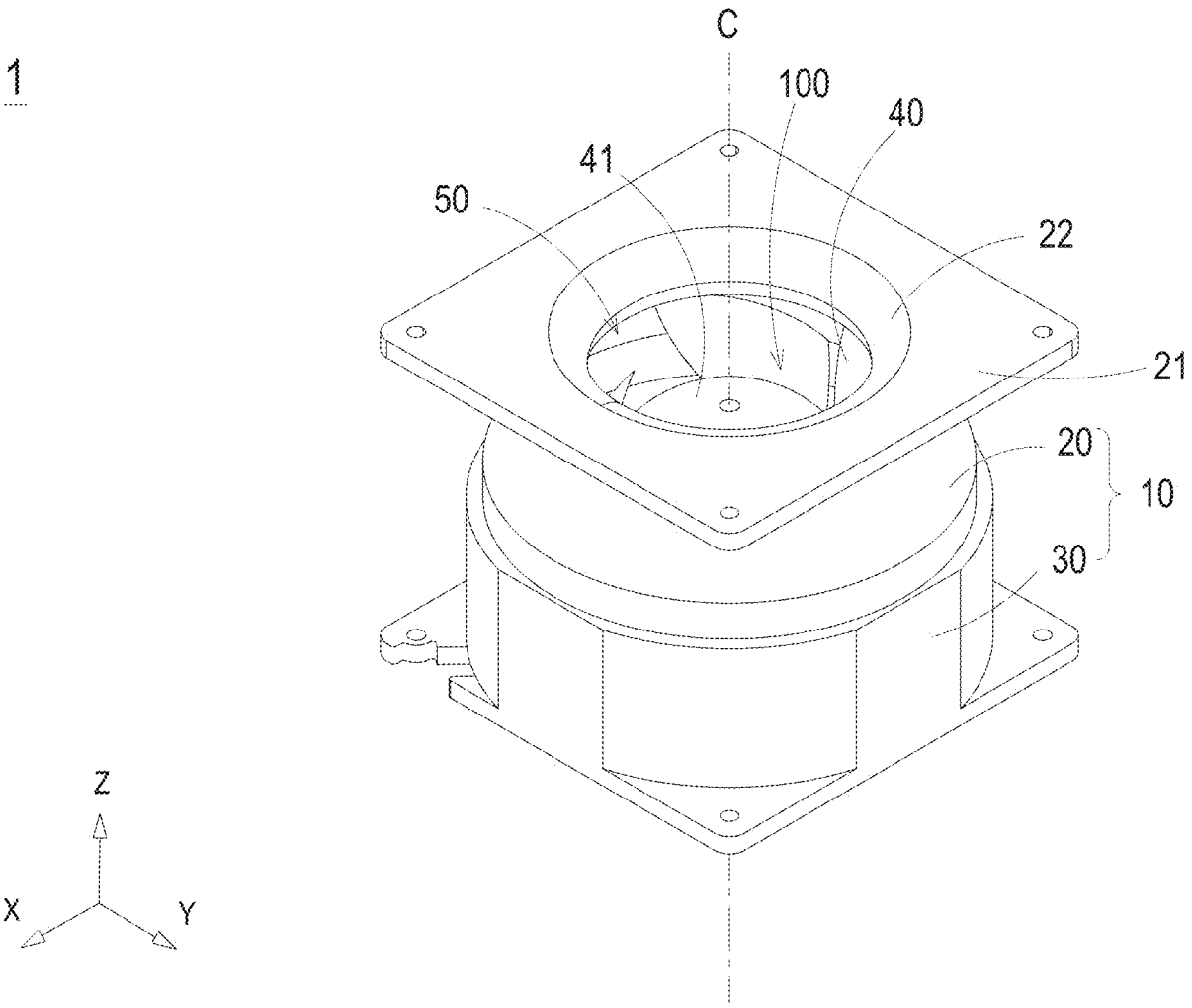
FIG. 1 is a perspective view illustrating a diagonal fan according to a first embodiment of the present disclosure from an upper perspective.

The present disclosure will now be described more specifically with reference to the following embodiments. It is to be noted that the following descriptions of preferred embodiments of this disclosure are presented herein for purpose of illustration and description only. It is not intended to be exhaustive or to be limited to the precise form disclosed. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed. Further, spatially relative terms, such as "downwardly", "upwardly", "lower", "upper" and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly. When an element is referred to as being "connected," or "coupled," to another element, it can be directly connected or coupled to the other element or intervening elements may be present. Although the wide numerical ranges and parameters of the present disclosure are approximations, numerical values are set forth in the specific examples as precisely as possible. In addition, although the "first," "second," "third," and the like terms in the claims be used to describe the various elements can be appreciated, these elements should not be limited by these terms, and these elements are described in the respective embodiments are used to express the different reference numerals, these terms are only used to distinguish one element from another element. For example, a first element could be termed a second element, and, similarly, a second element could be termed a first element, without departing from the scope of example embodiments.

FIG. 1 is a perspective view illustrating a diagonal fan according to a first embodiment of the present disclosure from an upper perspective. In the embodiment, the diagonal fan 1 includes a frame 10 and impeller 40. The frame 10 includes an upper frame 20 and a lower frame 30 assembled with each other to form an accommodation space 100 for accommodating the impeller 40. In the embodiment, the upper frame 20 includes an inlet 50 and a guiding wall 22 disposed thereon. The guiding wall 22 is extended downwardly from a periphery of the inlet 50 along an axial direction C into the accommodation space 100. The impeller 40 include a hub 41 exposed through the inlet 50 under the axial direction C. In the embodiment, the upper frame 20 includes an upper frame plate 21, for example in a square shape, disposed on an upper end of the upper frame 20. The inlet 50 is located on the upper frame 20. Preferably but not exclusively, the inlet 50 is circular and runs through the upper frame plate 21. Preferably but not exclusively, the guiding wall 22 is an annular curved surface in appearance and connected to the upper frame plate 21. The guiding wall 22 is extended downwardly from the periphery of the inlet 50 into the accommodation space 100 so that the air is introduced into the accommodation space 100 when the impeller 40 is rotated.

Figure 2:
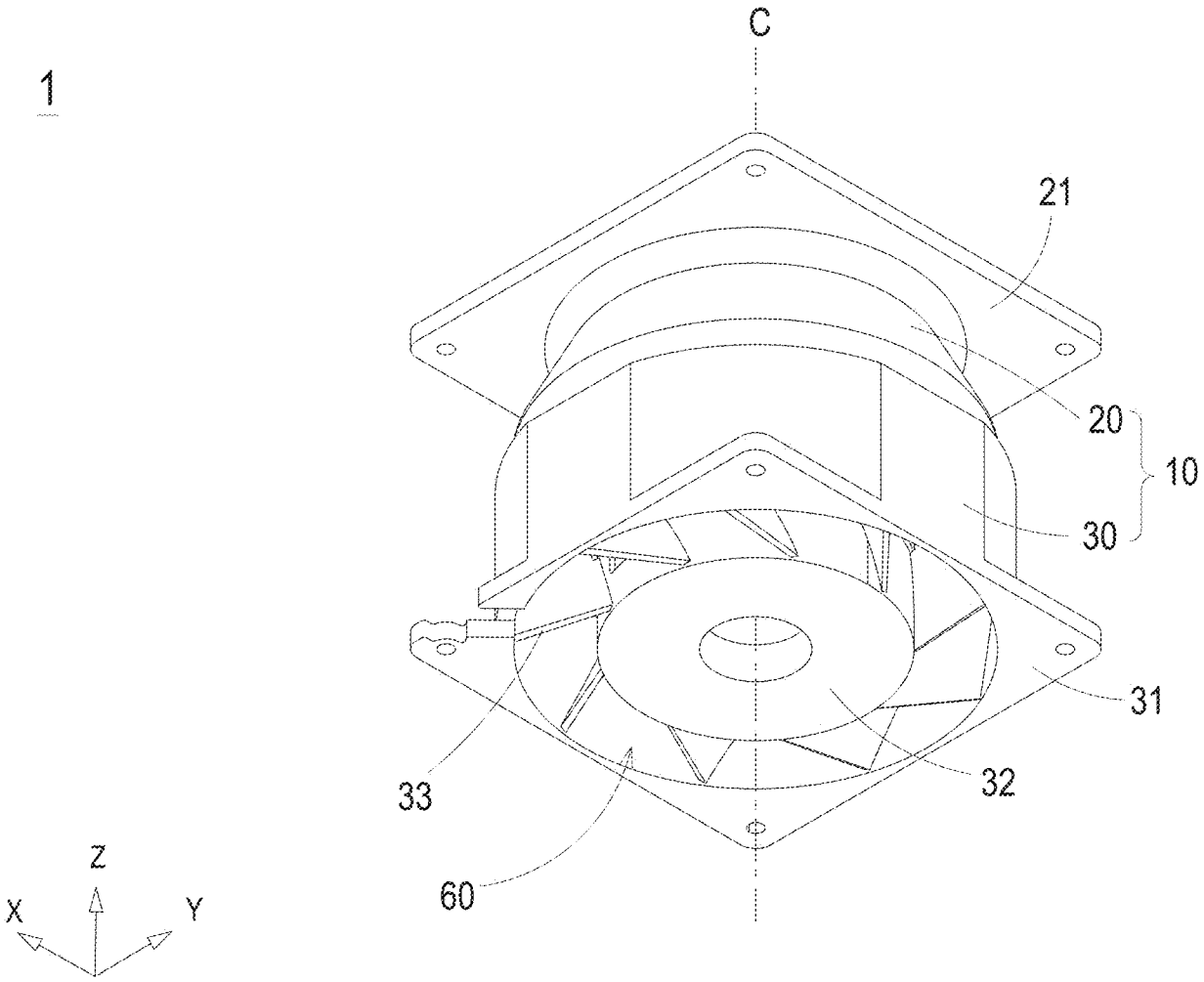
FIG. 2 is a perspective view illustrating the diagonal fan according to the first embodiment of the present disclosure from a lower perspective.

FIG. 2 is a perspective view illustrating the diagonal fan according to the first embodiment of the present disclosure from a lower perspective. In the embodiment, the lower frame 30 includes a lower frame plate 31, a base 32 and a plurality of static blades 33. The lower frame plate 31 is spatially corresponding to the upper frame plate 21. Preferably but not exclusively, the upper frame plate 21 and the lower frame plate 31 are approximately parallel to each other. The plurality of static blades 33 are disposed between the base 32 and the lower frame plate 31, and two ends of each of the static blades 33 are connected to the base 32 and the lower frame plate 31, respectively, so as to form an outlet 60. In that, the outlet 60 is located between the lower frame plate 31 and the base 32. When the impeller 40 is rotated, the air in the accommodation space 100 is allowed to flow through the plurality of static blades 33, between the base 32 and the lower frame plate 31, and be discharged out through the outlet 60.

Figure 3:
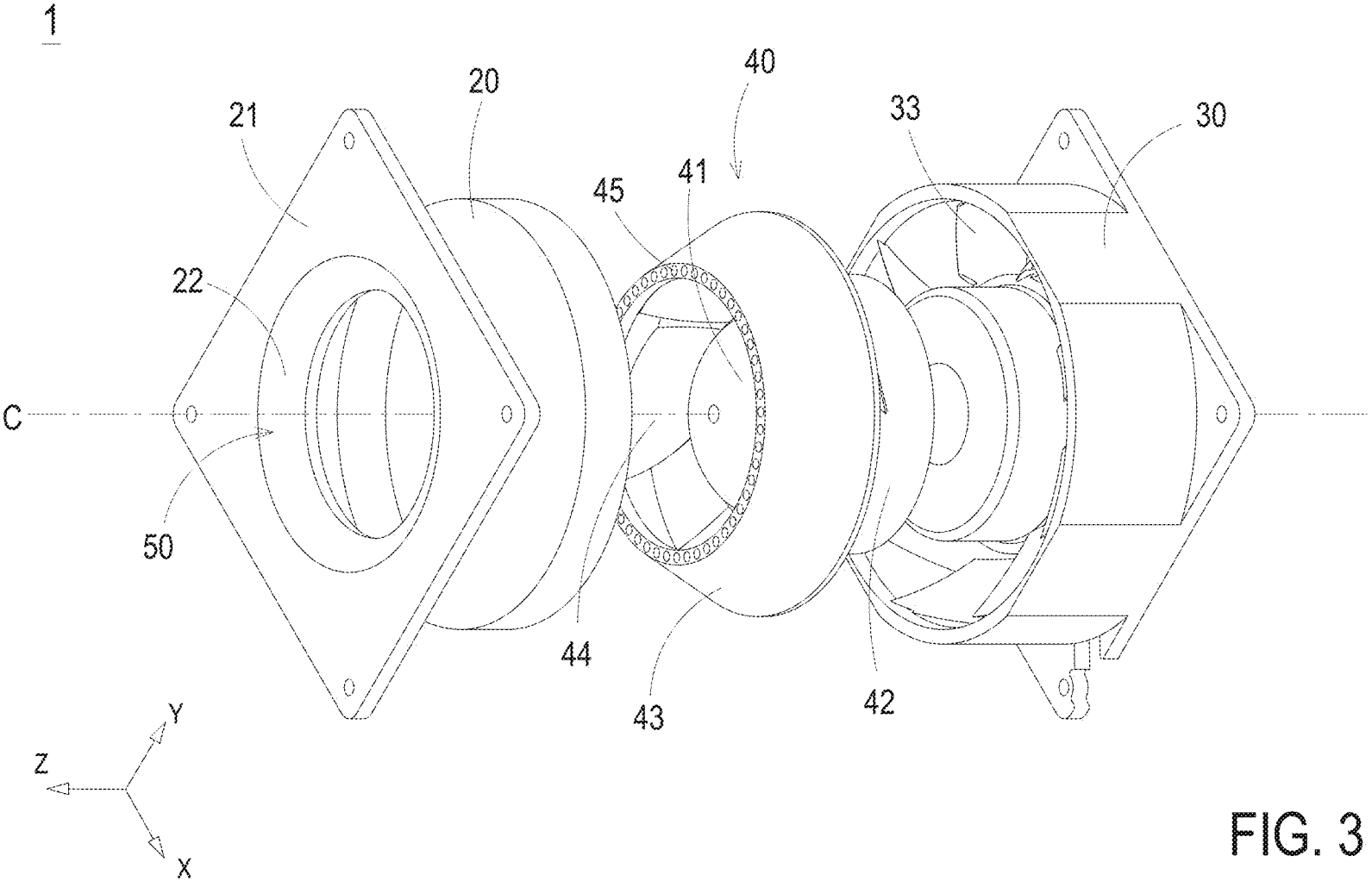
FIG. 3 is an exploded view illustrating the diagonal fan according to the first embodiment of the present disclosure.

FIG. 3 is an exploded view illustrating the diagonal fan according to the first embodiment of the present disclosure. In the embodiment, the frame 10 is formed by assembling the upper frame 20 and the lower frame 30. Preferably but not exclusively, the upper frame 20, the impeller 40 and the lower frame 30 are arranged along the axial direction C so that the impeller 40 is allowed to be placed in the accommodation space 100 when the upper frame 20 and the lower frame 30 are assembled together. In the embodiment, the impeller 40 includes a hub 41, a cylindrical part 42, a conical section shell 43, a plurality of blades 44 and a plurality of balance holes 45. The plurality of blades 44 of the impeller 40 are connected between the hub 41 and the conical section shell 43. The plurality of balance holes 45 are disposed on a flat annular plane of the upper end of the conical section shell 43. In other embodiments, the number, the shape and the size of the balance holes 45 are adjustable according to the practical requirements. The present disclosure is not limited thereto.

Figure 4B:
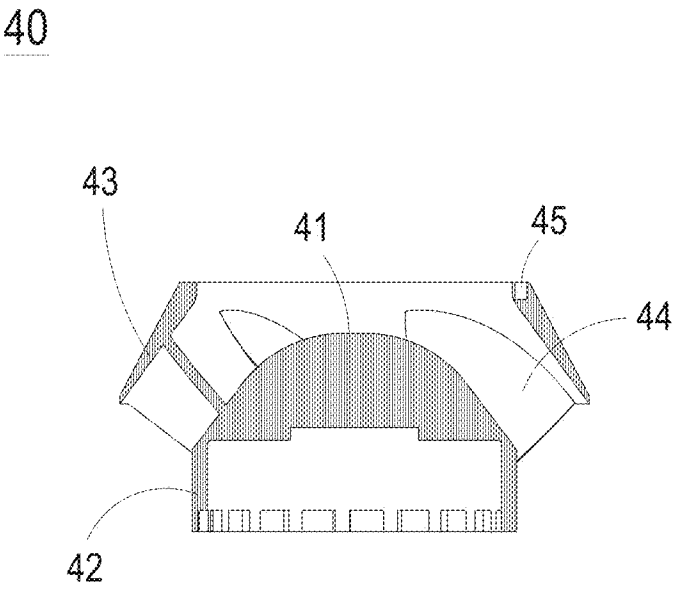
FIG. 4B is a cross-section view illustrating the impeller according to the first embodiment of the present disclosure.
Figure 4A:
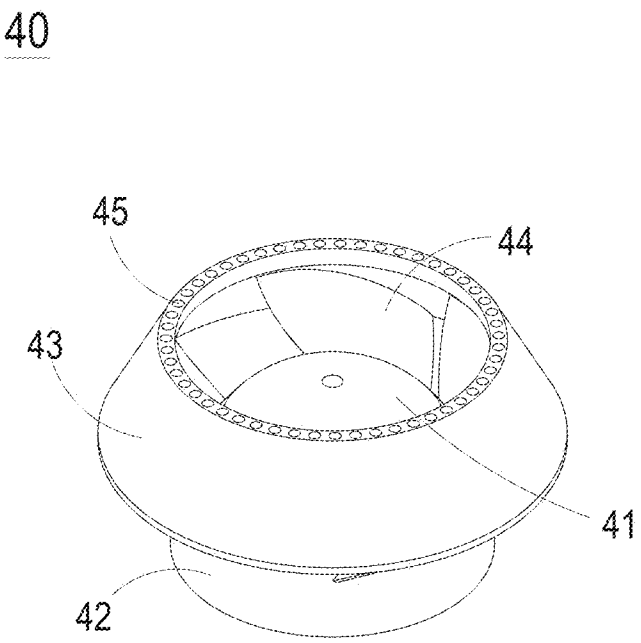
FIG. 4A is a perspective view illustrating the impeller according to the first embodiment of the present disclosure.

FIG. 4A is a perspective view illustrating the impeller according to the first embodiment of the present disclosure. In the embodiment, the hub 41, the cylindrical part 42, the conical section shell 43, the plurality of blades 44 and the plurality of balance holes 45 are integrally formed as a one piece by injection molding. The cylindrical part 42 is extended axially from a lower end of the hub 41. The conical section shell 43 and the hub 41 are arranged concentrically with each other, and the conical section shell 43 is connected to the periphery of the hub 41 through the plurality of blades 44. In the embodiment, each of the plurality of blades 44 is three-dimensionally curved. Preferably but not exclusively, each of the blades 44 includes an inner end connected to the hub 41 and an outer end connected to the inner annular wall of the conical section shell 43. As the cylindrical part 42 drives the hub 41, the plurality of blades 44 and the conical section shell 43 to rotate, the air is driven to flow among the hub 41, the plurality of blades 44 and the conical section shell 43.

FIG. 4B is a cross-section view illustrating the impeller according to the first embodiment of the present disclosure. In the embodiment, the plurality of blades 44 are disposed around the periphery of the hub 41, and the upper end of the conical section shell 43 is extended upwardly from the upper tips of the blades 44 so that the upper end of the conical section shell 43 is higher than the upper end of the hub 41 and the tips of the plurality of blades 44 connected with the conical section shell 43. The upper end of the hub 41 is lower than the upper end of the conical section shell 43. The outer diameter of the hub 41 of the impeller 40 is expended gradually in a direction from the inlet 50 toward the outlet 60.

Figure 5:
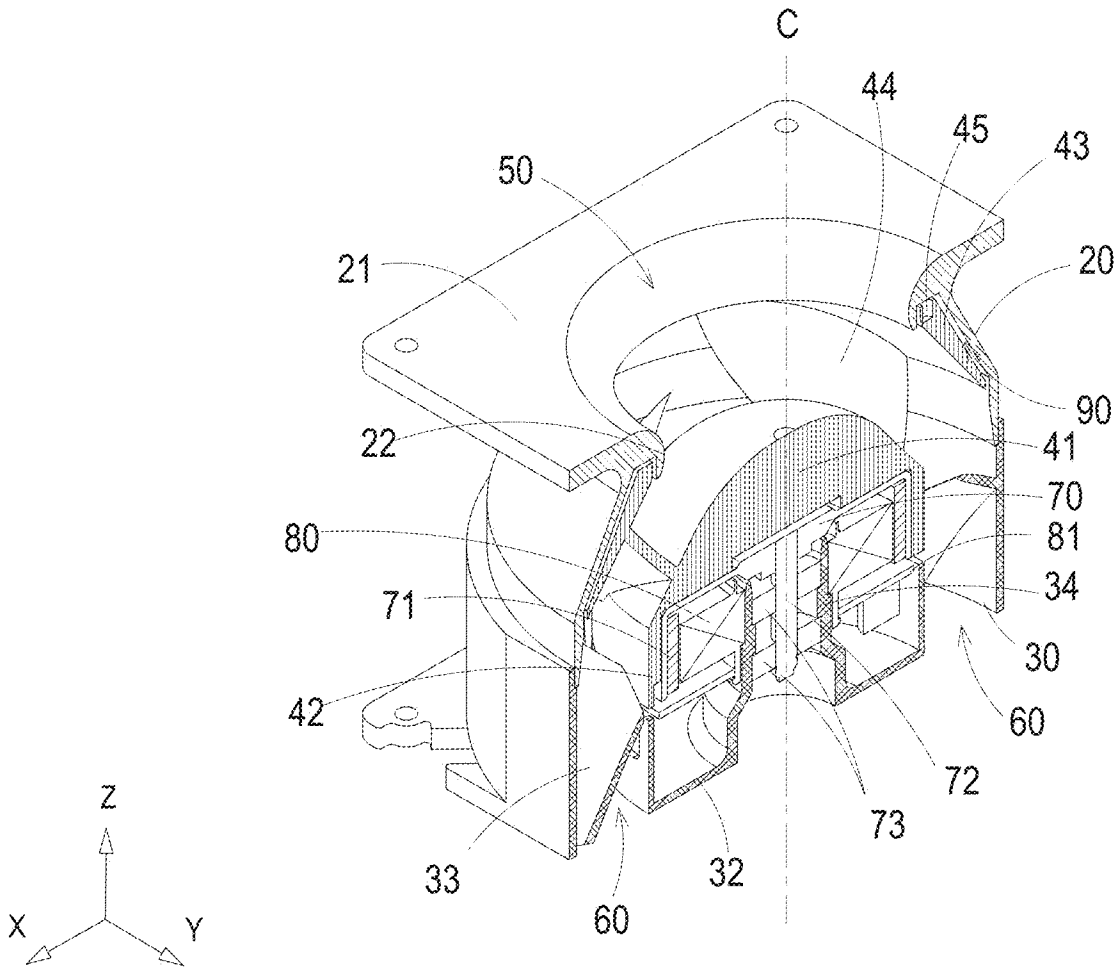
FIG. 5 is a cross-section structural view illustrating the diagonal fan according to the first embodiment of the present disclosure.

FIG. 5 is a cross-section structural view illustrating the diagonal fan according to the first embodiment of the present disclosure. In the embodiment, the base 32 of the lower frame 30 further includes a tube 34. Preferably but not exclusively, the stator includes a winding 80 and a printed circuit board 81. The winding 80 and the printed circuit board 81 are disposed on a periphery of the tube 34. The rotator includes a magnetic shell 70, a magnet 71 and a shaft 72. The magnetic shell 70 is disposed within the cylindrical part 42 of the impeller 40 and connected to the shaft 72. In the embodiment, the magnet 71 is disposed on a radially inner wall of the magnetic shell 70 and spatially corresponding to the winding 80. The shaft 72 is disposed at the center of the magnetic shell 70, and is disposed in the tube 34 through at least one bearing 73. On the other hand, in the embodiment, the guiding wall 22 is extended downwardly from the periphery of the inlet 50, and the upper end of the conical section shell 43 is extended upwardly from the outer ends of the blades 44, so that the upper frame 20 of the frame 10, the upper end of the conical section shell 43 and the guiding wall 22 are at least partially overlapped in view of the radial direction. The integrally formed upper frame body 20 and the guiding wall 22 are substantially parallel to the outer wall of the conical section shell 43 adjacent to the inlet 50 so that a backflow channel 90 is formed among the upper frame 20 of the frame 10, the outer side of the conical section shell 43 and the inner side of the guiding wall 22. Preferably but not exclusively, the backflow channel 90 is curved in multiple sections, so as to change the flow direction thereof.

Figure 6:
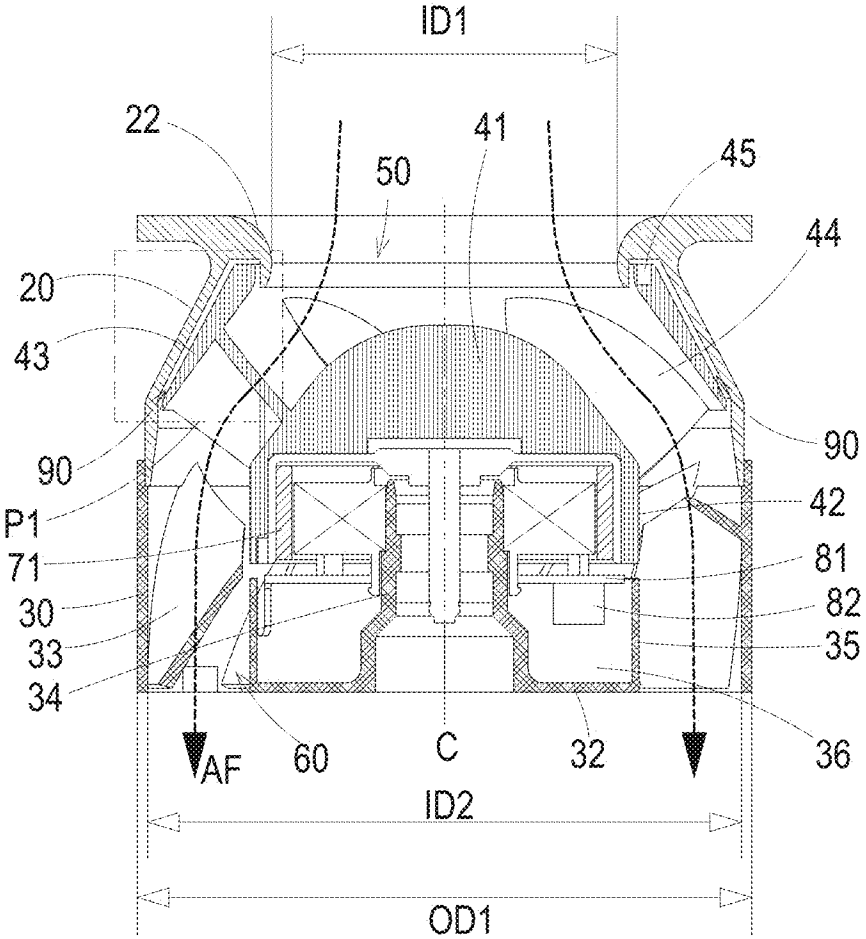
FIG. 6 is a cross-section view illustrating the diagonal fan according to the first embodiment of the present disclosure.

FIG. 6 is a cross-section view illustrating the diagonal fan according to the first embodiment of the present disclosure. In the embodiment, the rotor and the stator are accommodated between the impeller 40 and lower frame 30. A chamber 36 is formed between a base wall 35 of the base 32 and tube 34, and configured to accommodate an electronic component 82 on the printed circuit board 81. The upper end of the base 32 is spatially corresponding to a periphery of the cylindrical part 42. In the embodiment, the impeller 40 is rotated to form the airflow AF from the inlet 50 to the outlet 60. The inlet 50 and the outlet 60 are arranged substantially along the axial direction C. The airflow AF is inhaled through the inlet 50, flowing among the plurality of blades 44, the hub 41 and the conical section shell 43, transported among the static blades 33, the base 32 and the lower frame plate 31, and discharged out through the outlet 60. Since the outer diameter of the hub 41 of the impeller 40 is expended gradually in the direction from the inlet 50 toward the outlet 60, the airflow AF is expanded gradually around the periphery of the impeller 40. In the embodiment, the frame 10 has a frame diameter OD1, the inlet 50 has an inlet diameter ID1, and the outlet 60 has an outlet diameter ID2. Preferably but not exclusively, the inlet diameter ID1 is less than the outlet diameter ID2. In the embodiment, a ratio of the inlet diameter ID1 to the frame diameter OD1 is ranged from 0.5 to 0.7. Preferably but not exclusively, the ratio of the inlet diameter ID1 to the frame diameter OD1 is 0.56. In the embodiment, a ratio of the outlet diameter ID2 to the frame diameter OD1 is ranged from 0.8 to 0.98. Preferably but not exclusively, the ratio of the outlet diameter ID2 to the frame diameter OD1 is 0.97. The inlet diameter ID1 is less than the outlet diameter ID2, and the upper end of the conical section shell 43 is extended upwardly from the tips of the blades 44.

Figure 7:
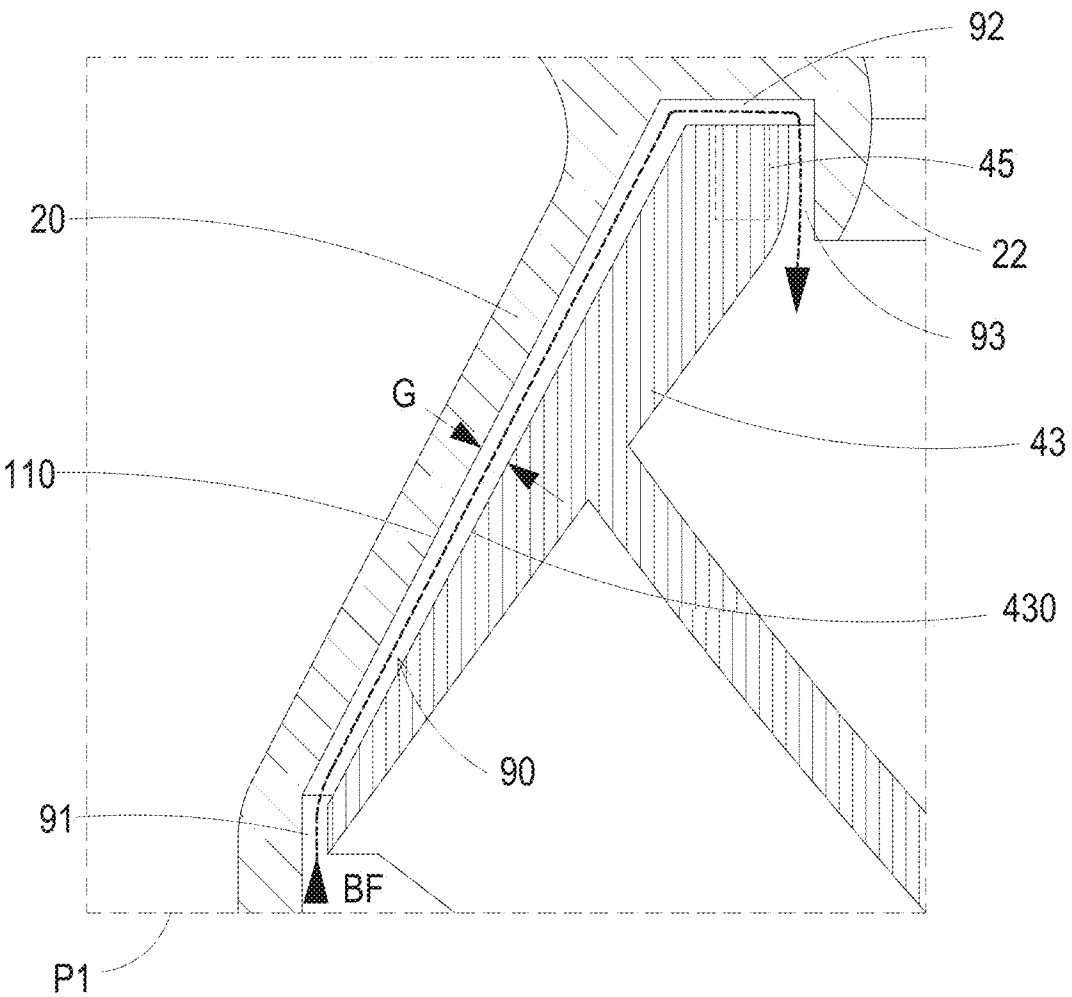
FIG. 7 is an enlarged view showing the region P1 in FIG. 6.

FIG. 7 is an enlarged view showing the region P1 shown in FIG. 6. In the embodiment, a gap having a spacing distance G is substantially maintained between an inner wall surface 110 of the upper frame 20 and an outer wall 430 of the upper end of the conical section shell 43 to form the aforementioned backflow channel 90. In the embodiment, a ratio of the spacing distance G to the frame diameter OD1 (referring to FIG. 6) is ranged from 0.01 to 0.02. Preferably but not exclusively, the ratio of the spacing distance G to the frame diameter OD1 is ranged from 0.0125. In the embodiment, the backflow channel 90 includes an intake section 91, a horizontal section 92 and an exhaust section 93. The intake section 91 is located adjacent to a lower end of the conical section shell 43 and in fluid communication with the exhaust section 93 through the horizontal section 92, and the upper end of the conical section shell 43 is at least partially shielded by the guiding wall 22 to form the exhaust section 93. Notably, the backflow BF flows in the intake section 91 along a direction reversed to that of the backflow BF flowing in the exhaust section 93. The backflow BF flows in the horizontal section 92 along a direction perpendicular to the axial direction C. The backflow BF flows in the exhaust section 93 along a direction identical to that of the airflow AF flowing. Since the inner wall surface 110 of the frame 10 and the outer wall 430 and the upper end of the conical section shell 43 are designed to be parallel to each other, and the gap having the spacing distance G is substantially maintained between the inner wall surface 110 of the frame 10, and the outer wall 430 and the upper end of the conical section shell 43 to form the backflow channel 90 curved in multiple sections, as the backflow BF is sucked into the backflow channel 90 through the intake section 91, the flow velocity and the kinetic energy of the flow field are reduced gradually. Therefore, the wind resistance between the inner wall surface 110 of the frame 10, and the outer wall 430 and the upper end of the conical section shell 43 is increased, the backflow BF sucked into the backflow channel 90 is reduced, and the turbulent flow intensity of the backflow channel 90 is eliminated simultaneously. In the embodiment, the conical section shell 43 includes the plurality of balance holes 45 disposed around the upper end of the conical section shell 43, and the horizontal section 92 is spatially corresponding to the plurality of balance holes 45. In the embodiment, the corresponding lengths of the intake section 91, the horizontal section 92 and the exhaust section 93 are varied and bent by adjusting the frame 10, the impeller 40 and the guiding wall 22. In other embodiments, the corresponding lengths and the relative bending angles of the intake section 91, the horizontal section 92 and the exhaust section 93 are adjustable according to the practical requirements. The present disclosure is not limited thereto.

Figure 8B:
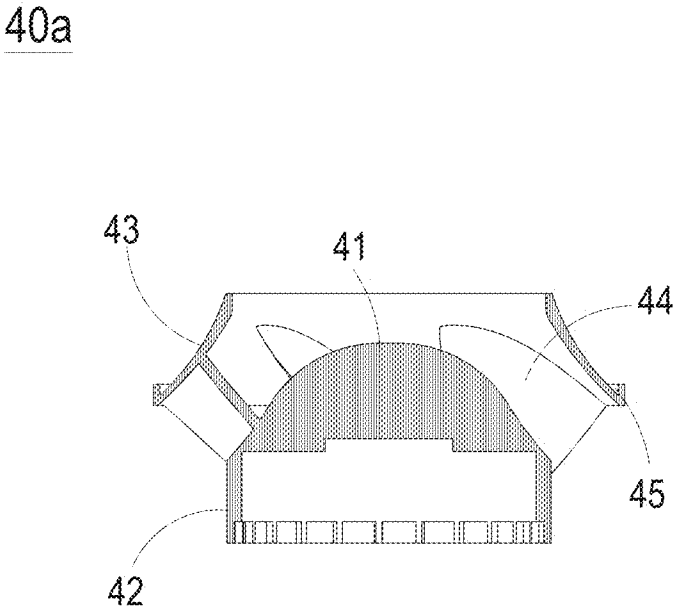
FIG. 8B is a cross-section view illustrating the impeller according to the second embodiment of the present disclosure.
Figure 8A:
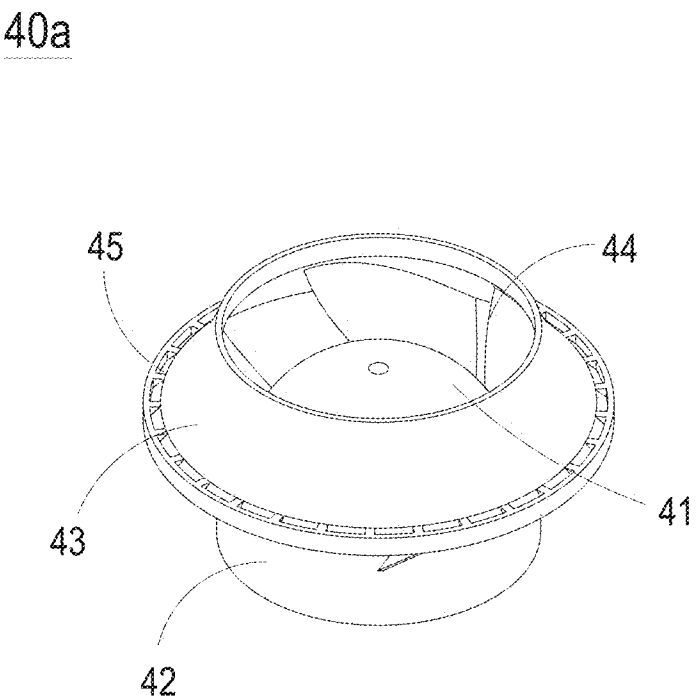
FIG. 8A is a perspective view illustrating an impeller according to a second embodiment of the present disclosure.

FIG. 8A is a perspective view illustrating an impeller according to a second embodiment of the present disclosure. In the embodiment, the impeller 40*a* includes a hub 41, a cylindrical part 42, a conical section shell 43, a plurality of blades 44 and a plurality of balance holes 45. The lower end of the hub 41 is connected to the cylindrical part 42, and the hub 41 and the cylindrical part 42 are integrally formed as a single piece by injection molding. Preferably but not exclusively, the conical section shell 43 and the hub 41 are arranged concentrically with each other, and the conical section shell 43 is connected to the outer part of the hub 41 through the plurality of blades 44. In the embodiment, each of the plurality of blades 44 is three-dimensionally curved. Preferably but not exclusively, each of the blades 44 includes an inner end connected to the hub 41 and an outer end connected to the inner ring wall of the conical section shell 43. As the cylindrical part 42 drives the hub 41, the plurality of blades 44 and the conical section shell 43 to rotate, the air is driven to flow among the hub 41, the plurality of blades 44 and the conical section shell 43. The lower end of the conical section shell 43 is protruded outwardly in the radial direction so as to form an annular plane. Preferably but not exclusively, the plurality of balance holes 45 are annularly arranged at the lower end of the conical section shell 43 and located at the annular plane protruded outwardly from the lower end of the conical section shell 43. Moreover, the opening of each of balance holes 45 is faced upwardly.

FIG. 8B is a cross-section view illustrating the impeller according to the second embodiment of the present disclosure. In the embodiment, the plurality of blades 44 are disposed around the periphery of the hub 41, and the upper end of the conical section shell 43 is extended upwardly from the tips of the blades 44. In addition, a flat annular plane is formed on the upper end of the conical section shell 43. Preferably but not exclusively, the flat annular plane is higher than the tips of the plurality of blades 44 connected to the conical section shell 43, and is also higher than the upper end of the hub 41. Preferably but not exclusively, in the embodiment, the cylindrical par 42 is annular and includes a hollow portion, which is configured to accommodate the rotor and the stator, so that the impeller 40*a* is driven by the rotor and the stator to rotate. In conjunction with the change in the design of the balance holes 45, it helps to increase the varied applications of the impeller 40*a*.

Figure 9:
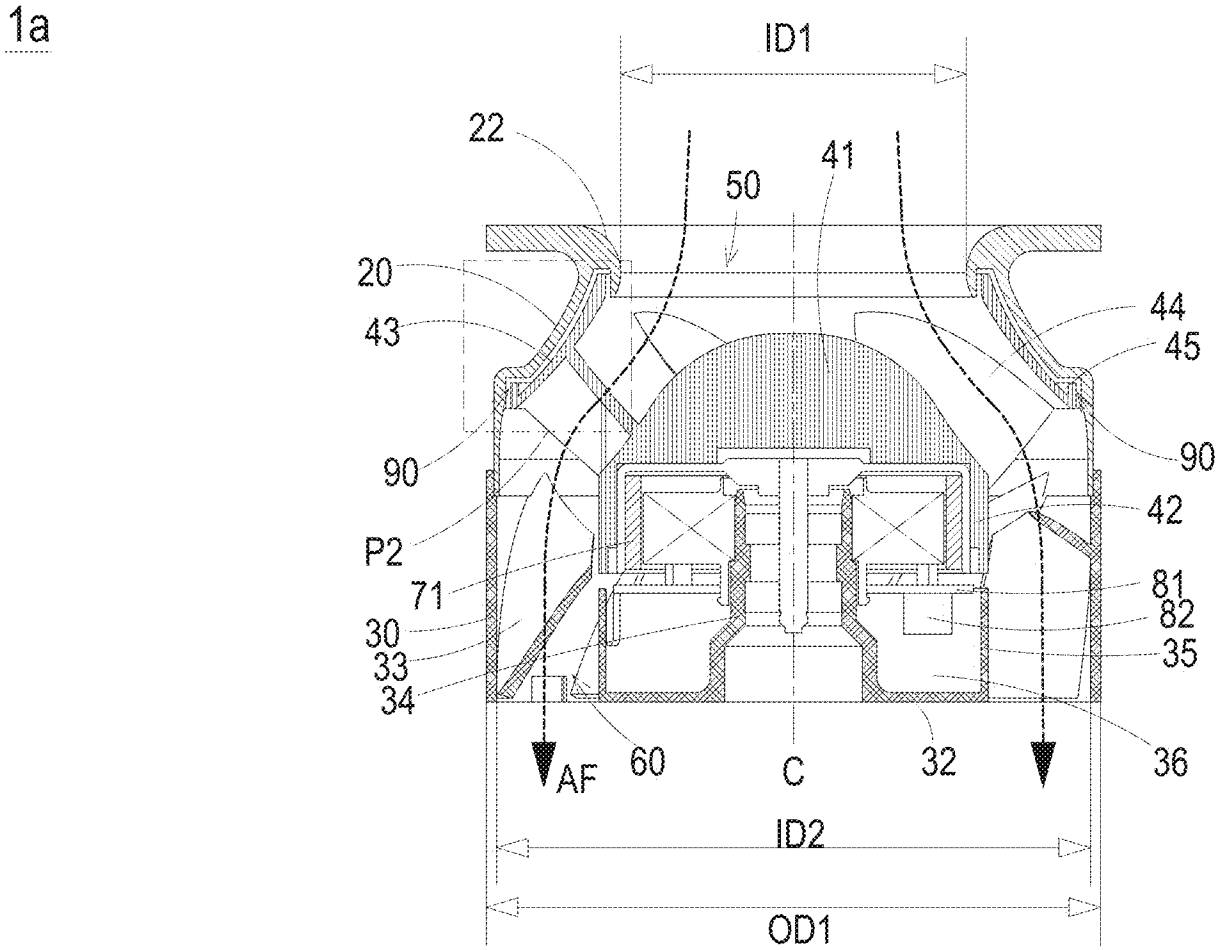
FIG. 9 is a cross-section view illustrating the diagonal fan according to the second embodiment of the present disclosure.

FIG. 9 is a cross-section view illustrating the diagonal fan according to the second embodiment of the present disclosure. In the embodiment, when the impeller 40*a* is rotated, an airflow AF is formed to flow from the inlet 50 to the outlet 60. The inlet 50 and the outlet 60 are substantially arranged along the axial direction C. The airflow AF is inhaled through the inlet 50, flowing among the plurality of blades 44, the hub 41 and the conical section shell 43, transported among the static blade 33, the base 32 and the lower frame plate 31, and discharged out through the outlet 60. Since the outer diameter of the hub 41 of the impeller 40*a* is expended gradually in the direction from the inlet 50 toward the outlet 60, the airflow AF is expanded gradually around the periphery of the impeller 40*a*. In the embodiment, the frame 10 has a frame diameter OD1, the inlet 50 has an inlet diameter ID1, and the outlet 60 has an outlet diameter ID2. Preferably but not exclusively, the inlet diameter ID1 is less than the outlet diameter ID2. In the embodiment, a ratio of the inlet diameter ID1 to the frame diameter OD1 is ranged from 0.5 to 0.7. Preferably but not exclusively, the ratio of the inlet diameter ID1 to the frame diameter OD1 is 0.56. In the embodiment, a ratio of the outlet diameter ID2 to the frame diameter OD1 is ranged from 0.8 to 0.98. Preferably but not exclusively, the ratio of the outlet diameter ID2 to the frame diameter OD1 is 0.97.

Figure 10:
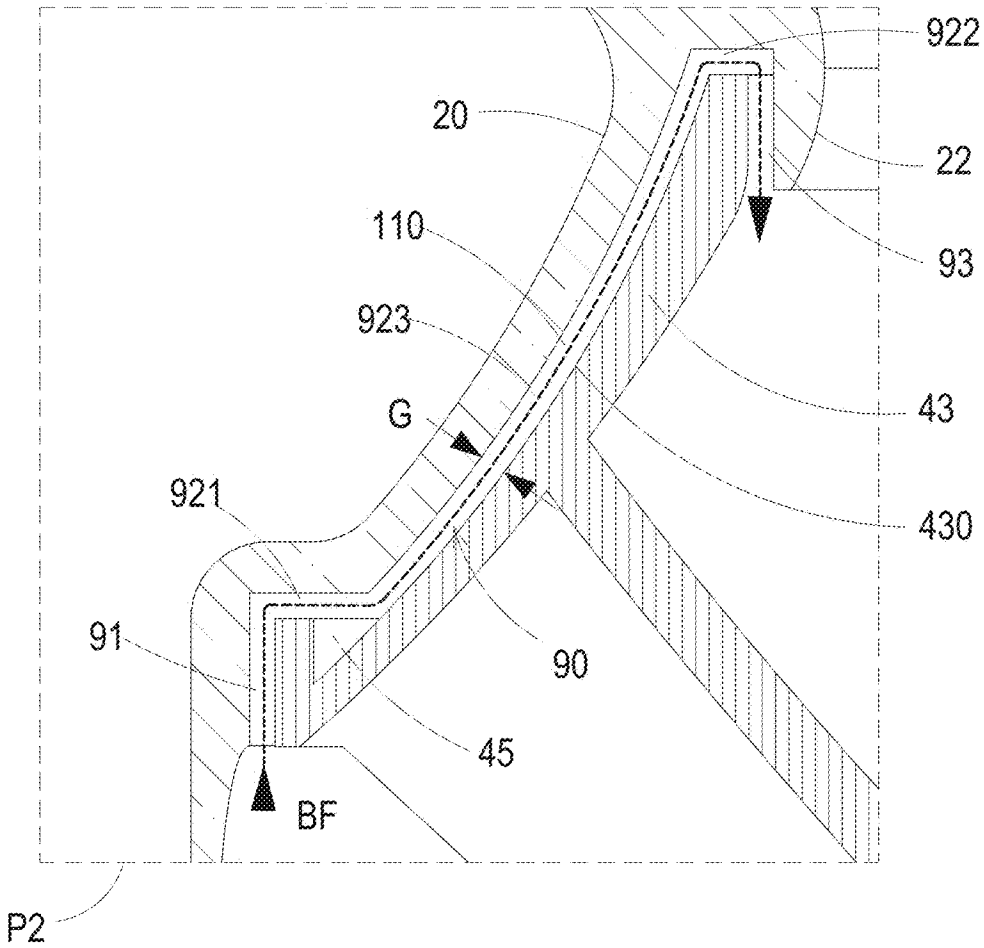
FIG. 10 is an enlarged view showing the region P2 in FIG. 9.

FIG. 10 is an enlarged view showing the region P2 in FIG. 9. In the embodiment, a gap having a spacing distance G is substantially maintained between an inner wall surface 110 of the upper frame 20 and an outer wall 430 of the upper end of the conical section shell 43 to form the aforementioned backflow channel 90. In the embodiment, a ratio of the spacing distance G to the frame diameter OD1 (referring to FIG. 9) is ranged from 0.01 to 0.02. Preferably but not exclusively, the ratio of the spacing distance G to the frame diameter OD1 is ranged from 0.0125. In the embodiment, the backflow channel 90 includes an intake section 91, a first horizontal section 921, a second horizontal section 922, a communication section 923 and an exhaust section 93. The intake section 91 is located adjacent to the lower end of the conical section shell 43, and in fluid communication with the exhaust section 93 through the first horizontal section 921, the communication section 923 and the second horizontal section 922, sequentially. Moreover, the upper end of the conical section shell 43 is at least partially shielded by the guiding wall 22 to form the exhaust section 93. Notably, the backflow BF flows in the intake section 91 along a direction, which is reversed to the direction of the backflow BF flowing in the exhaust section 93 and parallel to the axial direction C. The backflow BF flows in the first horizontal section 921 along a direction, which is perpendicular to the axial direction C and perpendicular to the intake section 91. The backflow BF flows in the second horizontal section 922 along a direction, which is perpendicular to the axial direction C and perpendicular to the exhaust section 93. The backflow BF flows in the exhaust section 93 along a direction identical to that of the airflow AF flowing. In the embodiment, the conical section shell 43 includes a plurality of balance holes 45 disposed around the lower end of the conical section shell 43. The first horizontal section 921 is spatially corresponding to the plurality of balance holes 45, and the backflow BF flows in the first horizontal section 921 along the direction perpendicular to the axial direction C. In the embodiment, the inner wall surface 110 of the frame 10 and the outer wall 430 and the upper end of the conical section shell 43 are designed to be parallel to each other, and a gap having a spacing distance G is substantially maintained between the inner wall surface 110 of the frame 10, and the outer wall 430 and the upper end of the conical section shell 43 to form the backflow channel 90 curved in multiple sections. Preferably but not exclusively, the backflow channel 90 includes at least two vertical bending portions. As the backflow BF is sucked into the backflow channel 90 through the intake section 91, the flow velocity and the kinetic energy of the flow field are reduced gradually. Therefore, the wind resistance between the inner wall surface 110 of the frame 10, and the outer wall 430 and the upper end of the conical section shell 43 is increased, the backflow BF sucked into the backflow channel 90 is reduced, and the turbulent flow intensity of the backflow channel 90 is eliminated simultaneously.

Figure 11:
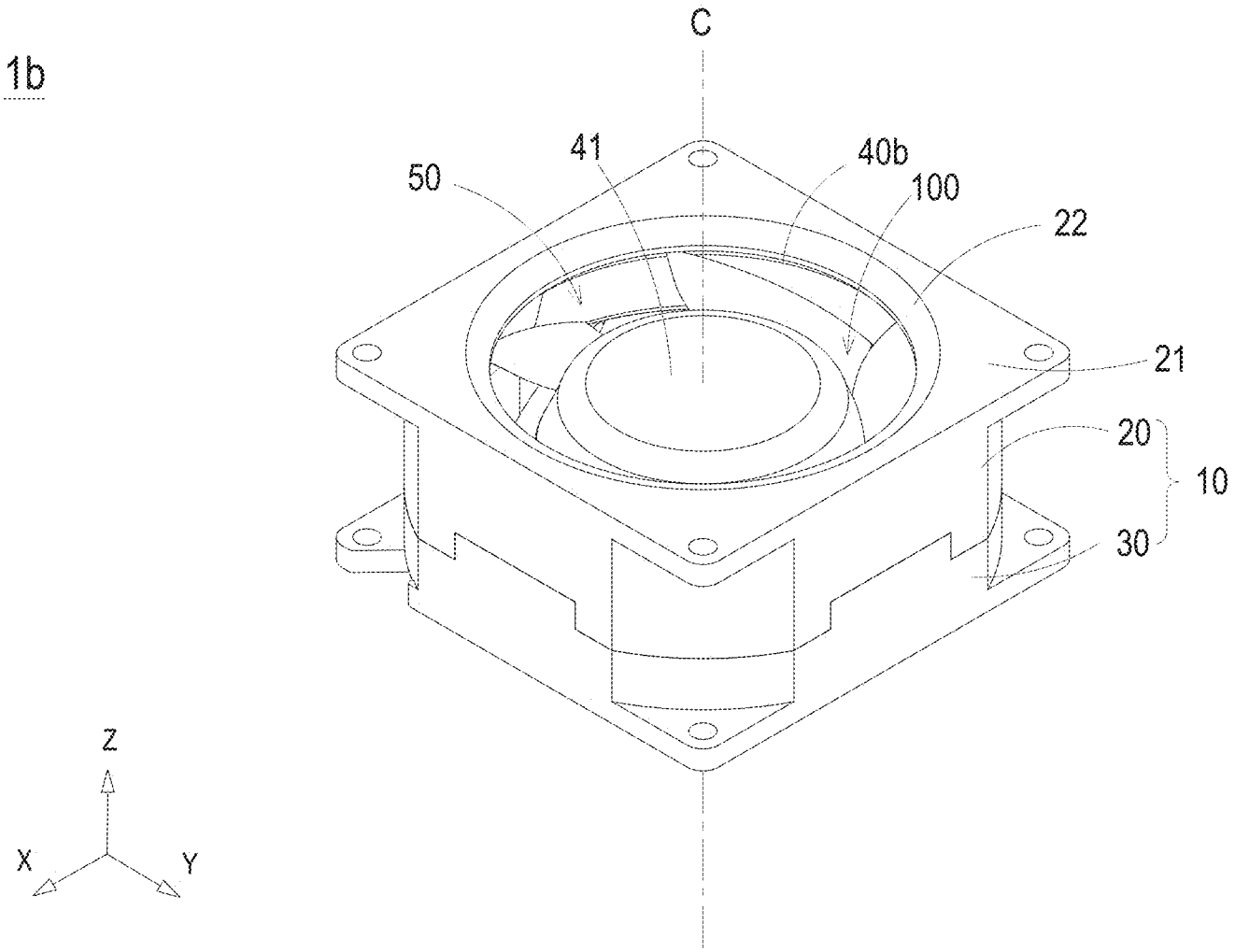
FIG. 11 is a perspective view illustrating a diagonal fan according to a third embodiment of the present disclosure.

FIG. 11 is a perspective view illustrating a diagonal fan according to a third embodiment of the present disclosure. In the embodiment, the structures, elements and functions of the diagonal fan 1*b* are similar to those of the diagonal fan 1 of FIGS. 1 to 3, and are not redundantly described herein. In the embodiment, the diagonal fan 1*b* is of a flat design, and the frame 10 is formed by assembling an upper frame 20 and a lower frame 30. The accommodation space 100 is configured to accommodate the impeller 40*b*. In the embodiment, the inlet 50 and the guiding wall 22 are disposed on the upper frame 20. Preferably but not exclusively, the upper frame 20 includes a square upper frame plate 21 disposed at the upper end of the upper frame 20. The inlet 50 is located on the upper frame 20. Preferably but not exclusively, the inlet 50 is circular and runs through the upper frame plate 21. The guiding wall 22 is connected to the upper frame plate 21 and extended downwardly from the periphery of the inlet 50 into the accommodation space 100, so that the air is introduced into the accommodation space 100 when the impeller 40*b* is rotated. In addition, the upper end of the hub 41 includes a flat plane.

Figure 12:
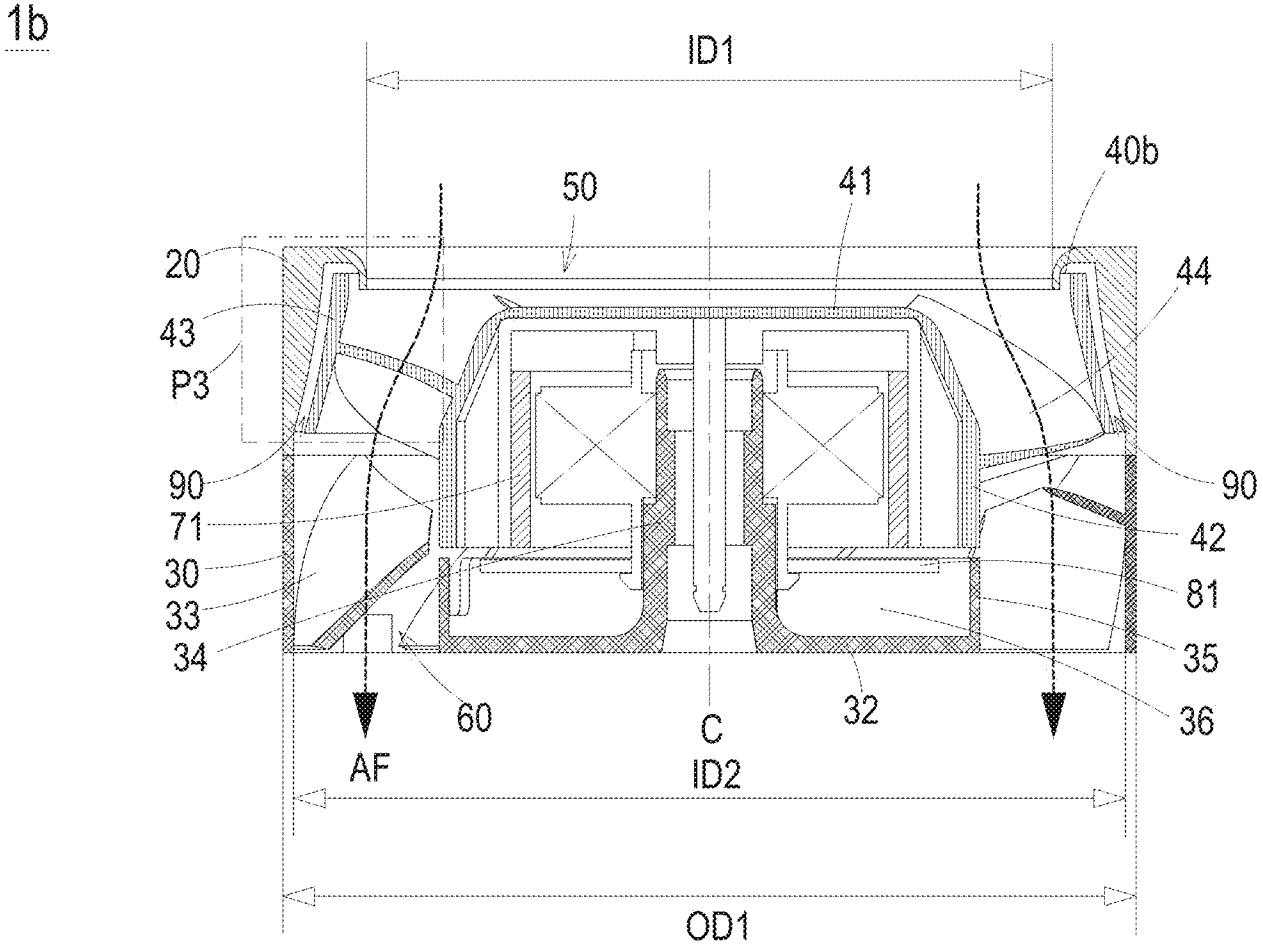
FIG. 12 is a cross-section view illustrating the diagonal fan according to the third embodiment of the present disclosure.

FIG. 12 is a cross-section view illustrating the diagonal fan according to the third embodiment of the present disclosure. In the embodiment, when the impeller 40*b* is rotated, an airflow AF is formed to flow from the inlet 50 to the outlet 60. The inlet 50 and the outlet 60 are arranged along the axial direction C. The airflow AF is inhaled through the inlet 50, flowing among the plurality of blades 44, the hub 41 and the conical section shell 43, transported among the static blade 33, the base 32 and the lower frame plate 31, and discharged out through the outlet 60. Since the outer diameter of the hub 41 of the impeller 40*b* is expended gradually in the direction from the inlet 50 toward the outlet 60, the airflow AF is expanded gradually around the periphery of the impeller 40*b*. In the embodiment, the frame 10 has a frame diameter OD1, the inlet 50 has an inlet diameter ID1, and the outlet 60 has an outlet diameter ID2. Preferably but not exclusively, the inlet diameter ID1 is less than the outlet diameter ID2. In the embodiment, a ratio of the inlet diameter ID1 to the frame diameter OD1 is ranged from 0.6 to 0.8. Preferably but not exclusively, the ratio of the inlet diameter ID1 to the frame diameter OD1 is 0.74. In the embodiment, a ratio of the outlet diameter ID2 to the frame diameter OD1 is ranged from 0.8 to 0.98. Preferably but not exclusively, the ratio of the outlet diameter ID2 to the frame diameter OD1 is 0.975.

Figure 13:
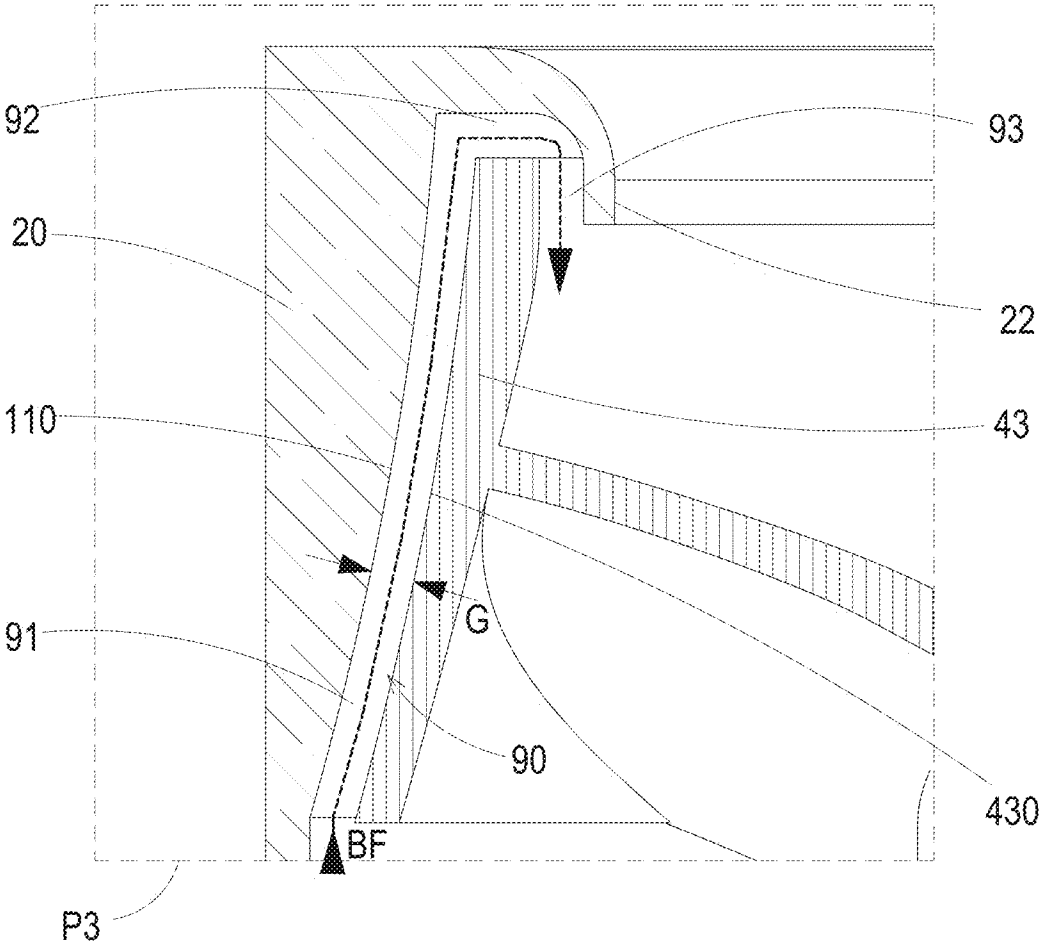
FIG. 13 is an enlarged view showing the region P3 in FIG. 12.

FIG. 13 is an enlarged view showing the region P3 in FIG. 12. In the embodiment, a gap having a spacing distance G is substantially maintained between an inner wall surface 110 of the upper frame 20 and an outer wall 430 and the upper end of the conical section shell 43 to form the aforementioned backflow channel 90. In the embodiment, a ratio of the spacing distance G to the frame diameter OD1 (referring to FIG. 12) is ranged from 0.01 to 0.02. Preferably but not exclusively, the ratio of the spacing distance G to the frame diameter OD1 is ranged from 0.0125. In the embodiment, the backflow channel 90 includes an intake section 91, a horizontal section 92 and an exhaust section 93. The intake section 91 is located adjacent to a lower end of the conical section shell 43 and in fluid communication with the exhaust section 93 through the horizontal section 92, and the upper end of the conical section shell 43 is at least partially shielded by the guiding wall 22 to form the exhaust section 93. Notably, the backflow BF flows in the intake section 91 along a direction reversed to that of the backflow BF flowing in the exhaust section 93. The backflow BF flows in the horizontal section 92 along a direction perpendicular to the axial direction C. The backflow BF flows in the exhaust section 93 along a direction identical to that of the airflow AF flowing. Since the inner wall surface 110 of the frame 10 and the outer wall 430 and the upper end of the conical section shell 43 are designed to be parallel to each other, and the gap having the spacing distance G is substantially maintained between the inner wall surface 110 of the frame 10, and the outer wall 430 and the upper end of the conical section shell 43 to form the backflow channel 90, as the backflow BF is sucked into the backflow channel 90 through the intake section 91, the flow velocity and the kinetic energy of the flow field are reduced gradually. Therefore, the wind resistance between the inner wall surface 110 of the frame 10, and the outer wall 430 and the upper end of the conical section shell 43 is increased, the backflow BF sucked into the backflow channel 90 is reduced, and the turbulent flow intensity of the backflow channel 90 is eliminated simultaneously. Preferably but not exclusively, in the embodiment, the arrangement of the aforementioned balance holes 45 is omitted in the impeller 40*b*, and the horizontal section 92 is spatially corresponding to the annular plane of the upper end of the conical section shell 43. On the other hand, when the impeller 40*b* is rotated, the backflow BF flows in the exhaust section 93 of the backflow channel 90 along a direction identical to that of the airflow AF flowing. In this way, when the backflow BF is converged into the airflow AF, the collision of flowing field is less likely to occur and the noise during operation is reduced.

Figure 14:
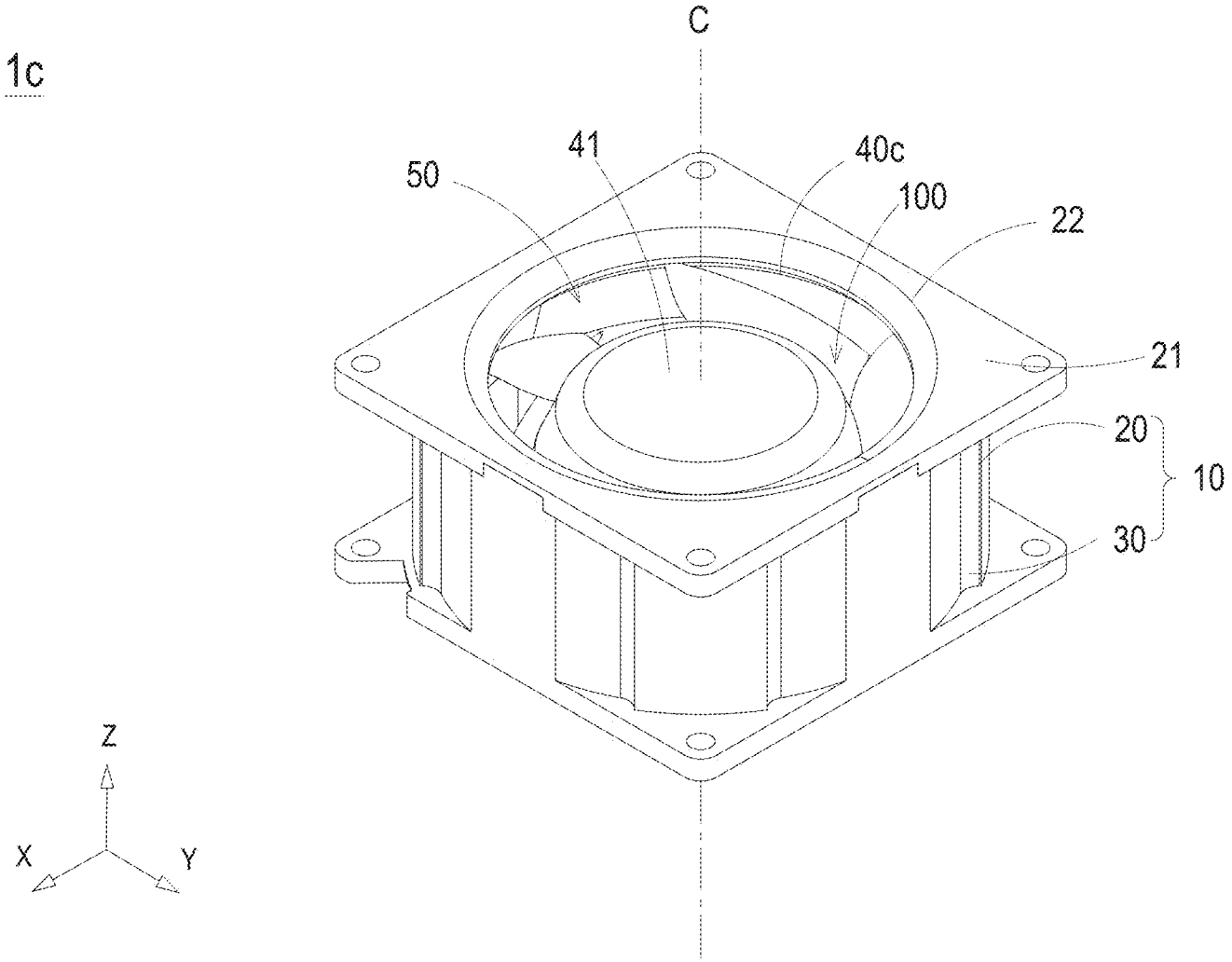
FIG. 14 is a perspective view illustrating a diagonal fan according to a fourth embodiment of the present disclosure.

FIG. 14 is a perspective view illustrating a diagonal fan according to a fourth embodiment of the present disclosure. In the embodiment, the structures, elements and functions of the diagonal fan 1*c* are similar to those of the diagonal fan 1*b* of FIGS. 11 to 12, and are not redundantly described herein. In the embodiment, the diagonal fan 1*c* is of a flat design, and the frame 10 is formed by assembling an upper frame 20 and a lower frame 30. Preferably but not exclusively, the upper frame 20 is a plate-like structure, and covered on the lateral walls of the lower frame 30 to form an accommodation space 100 configured to accommodate the impeller 40*c*. In the embodiment, the inlet 50 and the guiding wall 22 are disposed on the upper frame 20. Preferably but not exclusively, the upper frame 20 is a square upper frame plate 21 disposed on the upper end of the lower frame 30. The guiding wall 22 is connected to the upper frame plate 21 and extended downwardly from the periphery of the inlet 50 into the accommodation space 100, so that the air is introduced into the accommodation space 100 when the impeller 40*c* is rotated. Preferably but not exclusively, the upper end of the hub 41 includes a flat plane.

Figure 15:
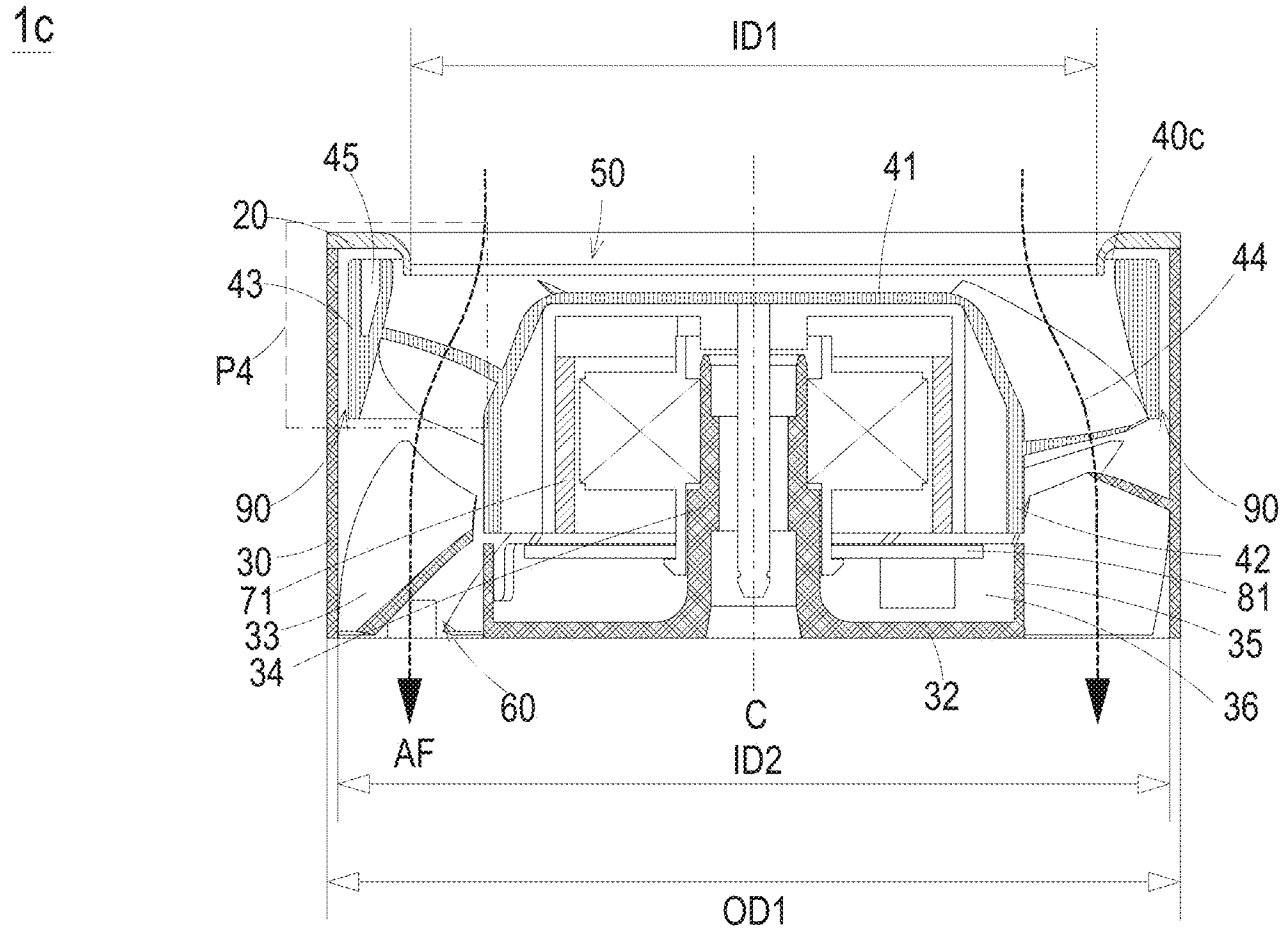
FIG. 15 is a cross-section view illustrating the diagonal fan according to the fourth embodiment of the present disclosure.

FIG. 15 is a cross-section view illustrating the diagonal fan according to the fourth embodiment of the present disclosure. In the embodiment, when the impeller 40*c* is rotated, an airflow AF is formed to flow from the inlet 50 to the outlet 60. The inlet 50 and the outlet 60 are arranged along the axial direction C. The airflow AF is inhaled through the inlet 50, flowing among the plurality of blades 44, the hub 41 and the conical section shell 43, transported among the static blade 33, the base 32 and the lower frame plate 31, and discharged out through the outlet 60. Since the outer diameter of the hub 41 of the impeller 40*c* is expended gradually in the direction from the inlet 50 toward the outlet 60, the airflow AF is expanded gradually around the periphery of the impeller 40*c*. In the embodiment, the frame 10 has a frame diameter OD1, the inlet 50 has an inlet diameter ID1, and the outlet 60 has an outlet diameter ID2. Preferably but not exclusively, the inlet diameter ID1 is less than the outlet diameter ID2. In the embodiment, a ratio of the inlet diameter ID1 to the frame diameter OD1 is ranged from 0.6 to 0.8. Preferably but not exclusively, the ratio of the inlet diameter ID1 to the frame diameter OD1 is 0.74. In the embodiment, a ratio of the outlet diameter ID2 to the frame diameter OD1 is ranged from 0.8 to 0.98. Preferably but not exclusively, the ratio of the outlet diameter ID2 to the frame diameter OD1 is 0.975.

Figure 16:
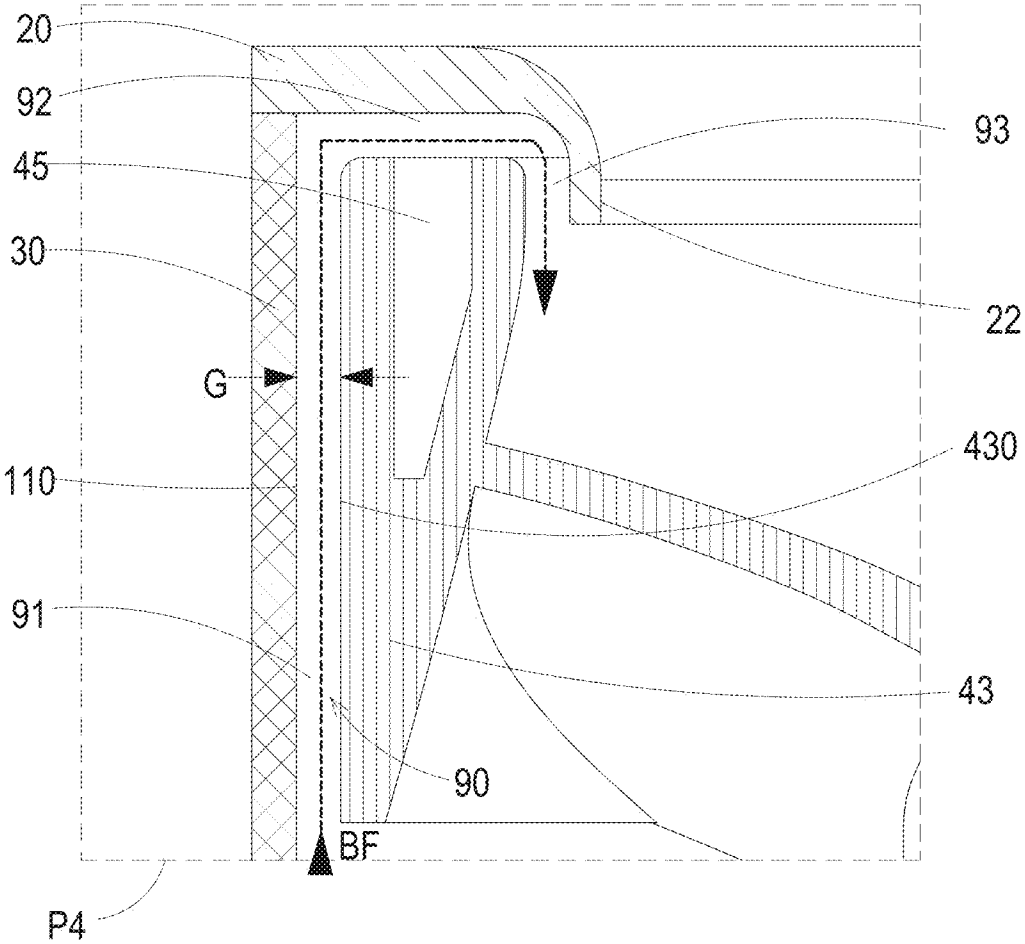
FIG. 16 is an enlarged view showing the region P4 in FIG. 15.

FIG. 16 is an enlarged view showing the region P4 in FIG. 15. In the embodiment, a gap having a spacing distance G is substantially maintained between an inner wall surface 110 of the lower frame 30 and an outer wall 430 and the upper end of the conical section shell 43 to form the aforementioned backflow channel 90. In the embodiment, a ratio of the spacing distance G to the frame diameter OD1 (referring to FIG. 15) is ranged from 0.01 to 0.02. Preferably but not exclusively, the ratio of the spacing distance G to the frame diameter OD1 is ranged from 0.0125. In the embodiment, the backflow channel 90 includes an intake section 91, a horizontal section 92 and an exhaust section 93. The intake section 91 is located adjacent to a lower end of the conical section shell 43 and in fluid communication with the exhaust section 93 through the horizontal section 92, and the upper end of the conical section shell 43 is at least partially shielded by the guiding wall 22 to form the exhaust section 93. Preferably but not exclusively, in the embodiment, the inner wall surface 110 of the lower frame 30 and the outer wall 430 of the conical section shell 43 are parallel to the axial direction C. Notably, the backflow BF flows in the intake section 91 along a direction reversed to that of the backflow BF flowing in the exhaust section 93. The backflow BF flows in the horizontal section 92 along a direction, which is perpendicular to the axial direction C and also perpendicular to the intake section 91 and the exhaust section 93. The backflow BF flows in the exhaust section 93 along a direction identical to that of the airflow AF flowing. In the embodiment, the conical section shell 43 includes a plurality of balance holes 45 disposed around the upper end of the conical section shell 43. The horizontal section 92 is spatially corresponding to the plurality of balance holes 45, and the backflow BF flows in the horizontal section 92 along the direction perpendicular to the axial direction C. Since the inner wall surface 110 of the frame 10 and the outer wall 430 and the upper end of the conical section shell 43 are designed to be parallel to each other, and the gap having the spacing distance G is substantially maintained between the inner wall surface 110 of the frame 10, and the outer wall 430 and the upper end of the conical section shell 43 to form the backflow channel 90 including at least two vertical bending portions, as the backflow BF is sucked into the backflow channel 90 through the intake section 91, the flow velocity and the kinetic energy of the flow field are reduced gradually. Therefore, the wind resistance between the inner wall surface 110 of the frame 10, and the outer wall 430 and the upper end of the conical section shell 43 is increased, the backflow BF sucked into the backflow channel 90 is reduced, and the turbulent flow intensity of the backflow channel 90 is eliminated simultaneously. In the embodiment, the conical section shell 43 includes the plurality of balance holes 45 disposed around the upper end of the conical section shell 43, and the horizontal section 92 is spatially corresponding to the plurality of balance holes 45. Moreover, the horizontal section 92 is perpendicular to the intake section 91 and the exhaust section 93, and in communication between the intake section 91 and the exhaust section 93. In other words, the balance holes 45 on the impeller 40*c* are arranged and corresponding to the horizontal section 92 of the backflow channel 90. On the other hand, when the impeller 40*c* is rotated, the backflow BF flows in the exhaust section 93 of the backflow channel 90 along a direction identical to that of the airflow AF flowing. In this way, when the backflow BF is converged into the airflow AF, the collision of flowing field is less likely to occur and the noise during operation is reduced. Certainly, the diagonal fan 1*c* in the present disclosure is allowed to be combined and adjusted with the aforementioned technical features according to the practical requirements. In addition, the detailed structure of the backflow channel 90 in the present disclosure is adjustable according to the practical requirements. The present disclosure is not limited thereto.

Figure 17:
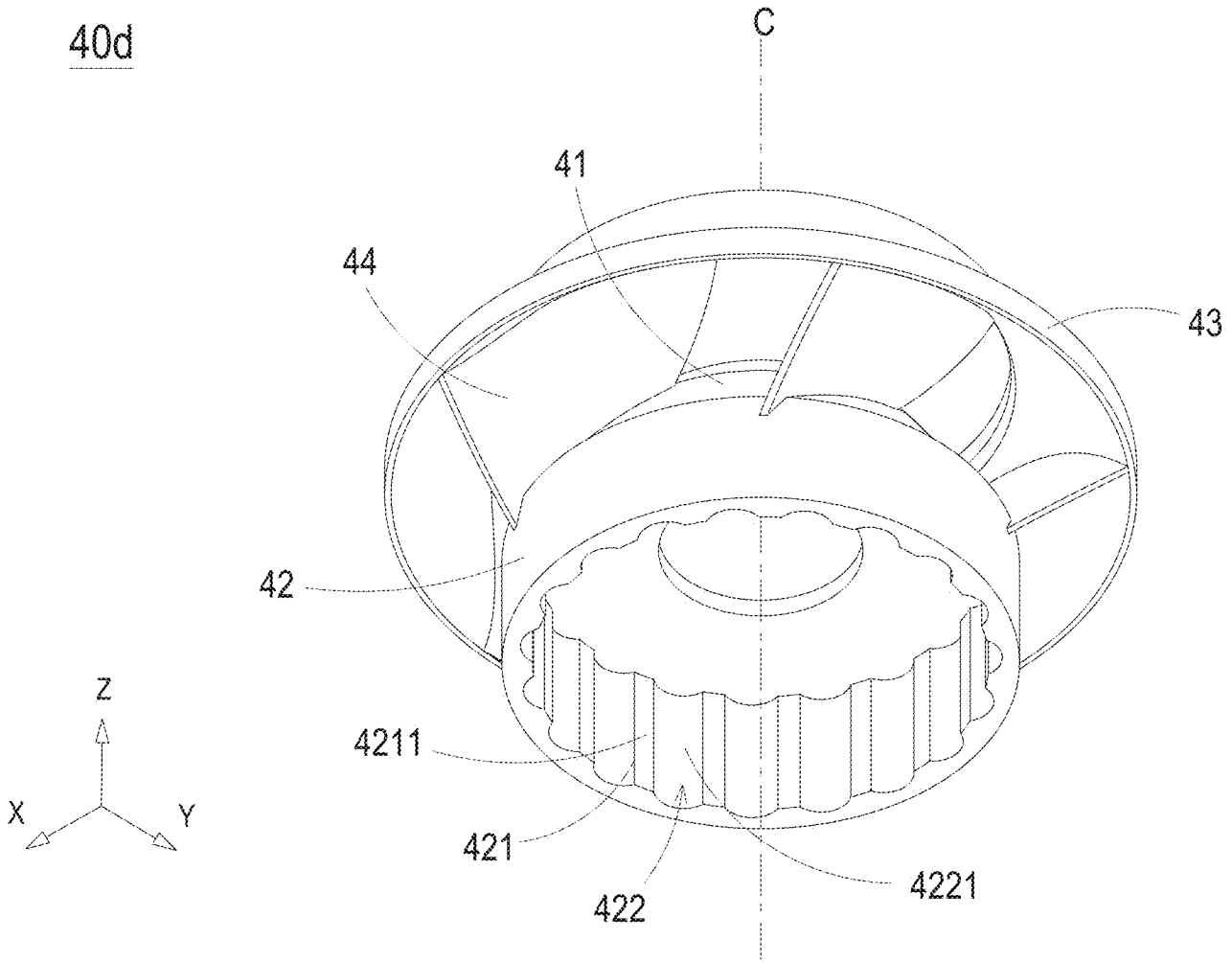
FIG. 17 is a perspective view illustrating an impeller according to a fifth embodiment of the present disclosure from a lower perspective.

FIG. 17 is a perspective view illustrating an impeller according to a fifth embodiment of the present disclosure from a lower perspective. In the embodiment, the impeller 40*d* includes a hub 41, a cylindrical part 42, a conical section shell 43, and a plurality of blades 44. The cylindrical part 42 includes a plurality of protrusion portions 421 and a plurality of indentation portions 422 disposed on an inner surface thereof, and the plurality of protrusion portions 421, the plurality of indentation portions 422 and the cylindrical part 42 are integrally formed as a one piece by injection molding. The plurality of protrusion portions 421 and the plurality of indentation portions 422 are elongated from the upper edge to the lower edge of the cylindrical part 42 along a direction parallel to the axial direction C, and are symmetrically arranged about the axial direction C in an alternate manner. Preferably but not exclusively, the shapes of the plurality of protrusion portions 421 are configured to be the same, and the shapes of the plurality of indentation portions 422 are also configured to be the same. In this embodiment, each of the plurality of indentation portions 422 is configured to have a concave surface 4221 facing the axial direction C and elongated from an upper end to a lower end thereof, and each of the plurality of protrusion portions 421 is configured to have a flat surface 4211 connecting two adjacent concave surfaces 4221 of two adjacent indentation portions 422, wherein a circular connection surface of the flat surfaces 4211 of the plurality of protrusion portions 421 and the inner surface of the cylindrical part 42 are coaxial. In other embodiments, the shapes and the arrangement of the plurality of protrusion portions 421 and the plurality of indentation portions 422 are adjustable according to the practical requirements. The present disclosure is not limited thereto.

Figure 18:
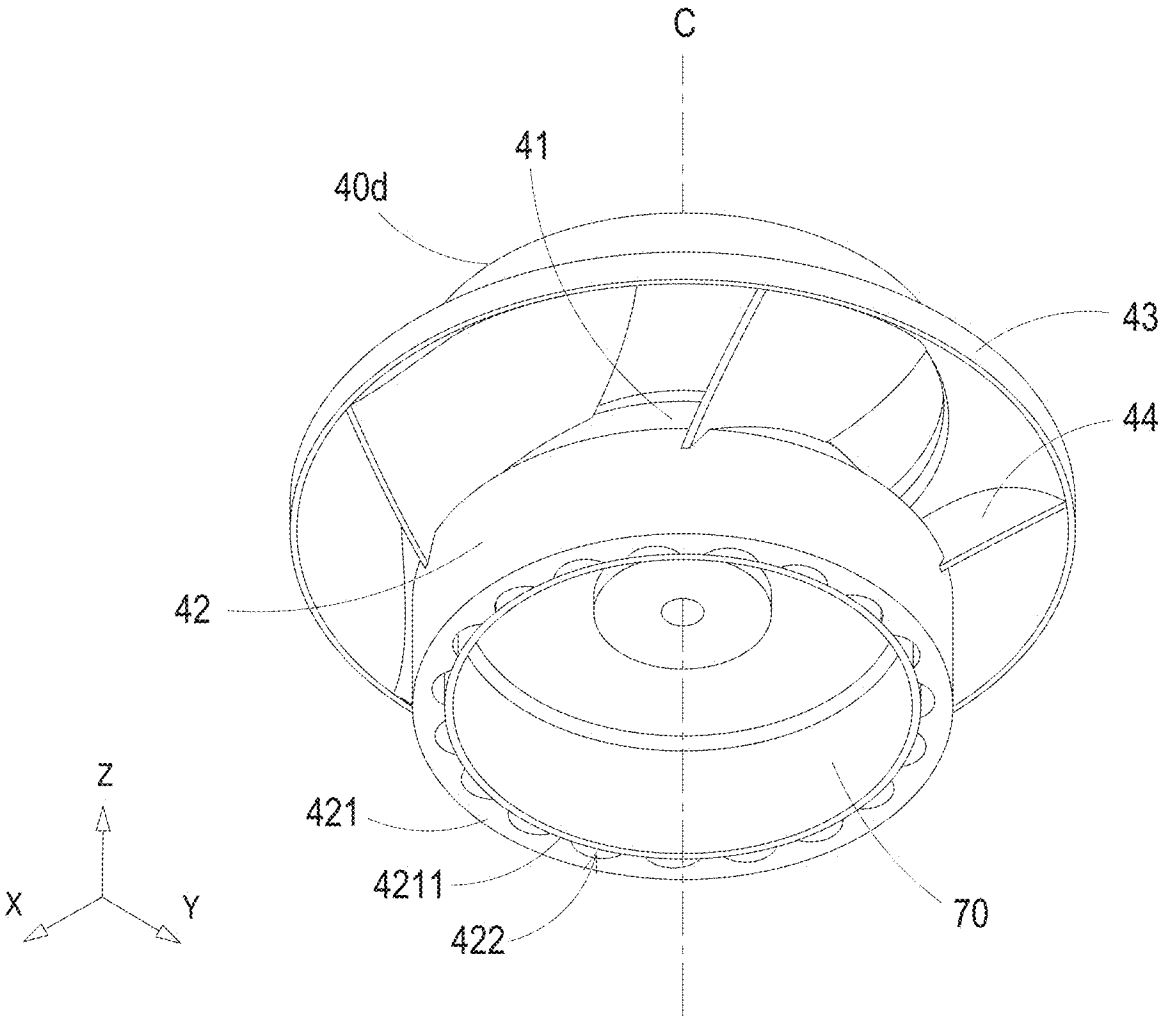
FIG. 18 is a perspective view illustrating the impeller shell assembled with the magnetic shell according to the fifth embodiment of the present disclosure from a lower perspective.

FIG. 18 is a perspective view illustrating the impeller shell assembled with the magnetic shell according to the fifth embodiment of the present disclosure from a lower perspective. In the embodiment, as the magnetic shell 70 of the rotor is assembled within the cylindrical part 42, the flat surfaces 4211 of the plurality of protrusion portions 421 are abutted against the outer surface of the magnetic 70, so the plurality of indentation portions 422 form a plurality of trenches between the magnetic shell 70 and the cylindrical part 42 of the impeller 40*d*. In this embodiment, adhesive materials are used for fixing the flat surfaces 4211 of the plurality of protrusion portions 421 on the outer surface of the magnetic shell 70, and the plurality of trenches provide overflowing spaces for the adhesive material when achieving the abutments between the flat surfaces 4211 and the outer surface of the magnetic shell 70. Moreover, the plurality of trenches also facilitate the balance adjustment of the diagonal fan by filling balancing clay.

Figure 19A:
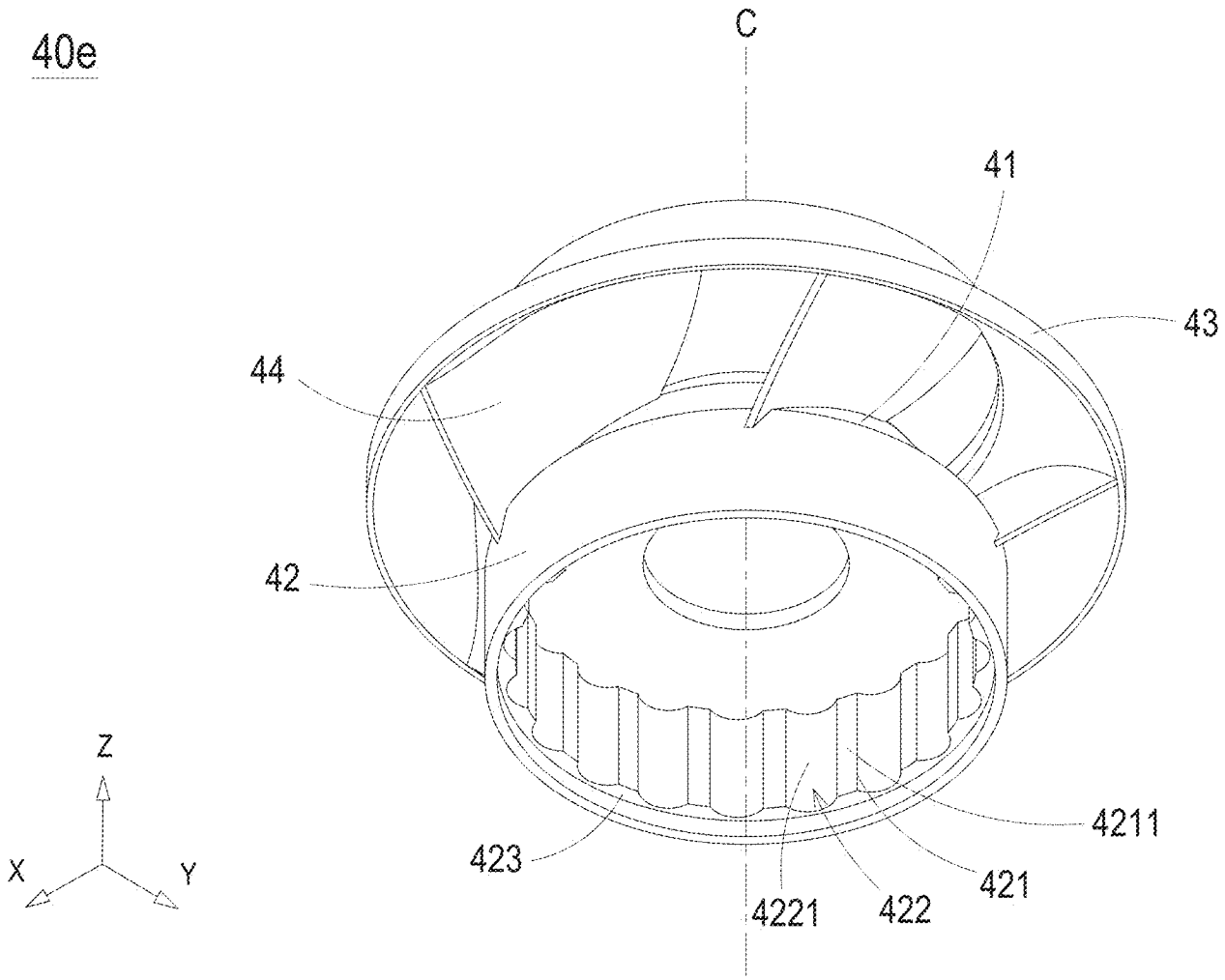
FIG. 19A is a perspective view illustrating an impeller shell according to a sixth embodiment of the present disclosure from a lower perspective.

FIG. 19A is a perspective view illustrating an impeller shell according to a sixth embodiment of the present disclosure from a lower perspective. In the embodiment, the structures, elements and functions of the impeller 40*e* are similar to those of the impeller 40*d* of FIG. 17, and are not redundantly described herein. In the embodiment, a plurality of protrusion portions 421 and a plurality indentation portions 422 are disposed on the inner surface of the cylindrical part 42 of the impeller 40*e*, elongated along a direction parallel to the axial direction C, and symmetrically arranged about the axial direction C in an alternate manner. Each of the plurality of indentation portions 422 is configured to have a concave surface 4221 facing the axial direction C and elongated from an upper end to a lower end thereof, and each of the plurality of protrusion portions 421 is configured to have a flat surface 4211 connecting two adjacent concave surfaces 4221 of two adjacent indentation portions 422, wherein a circular connection surface of the flat surfaces 4211 of the plurality of protrusion portions 421 and the inner surface of the cylindrical part 42 are coaxial. Furthermore, the plurality of protrusion portions 421 and the plurality of indentation portions 422 include a lower surface 423 at a position higher than the lower edge of the cylindrical part 42.

Figure 19B:
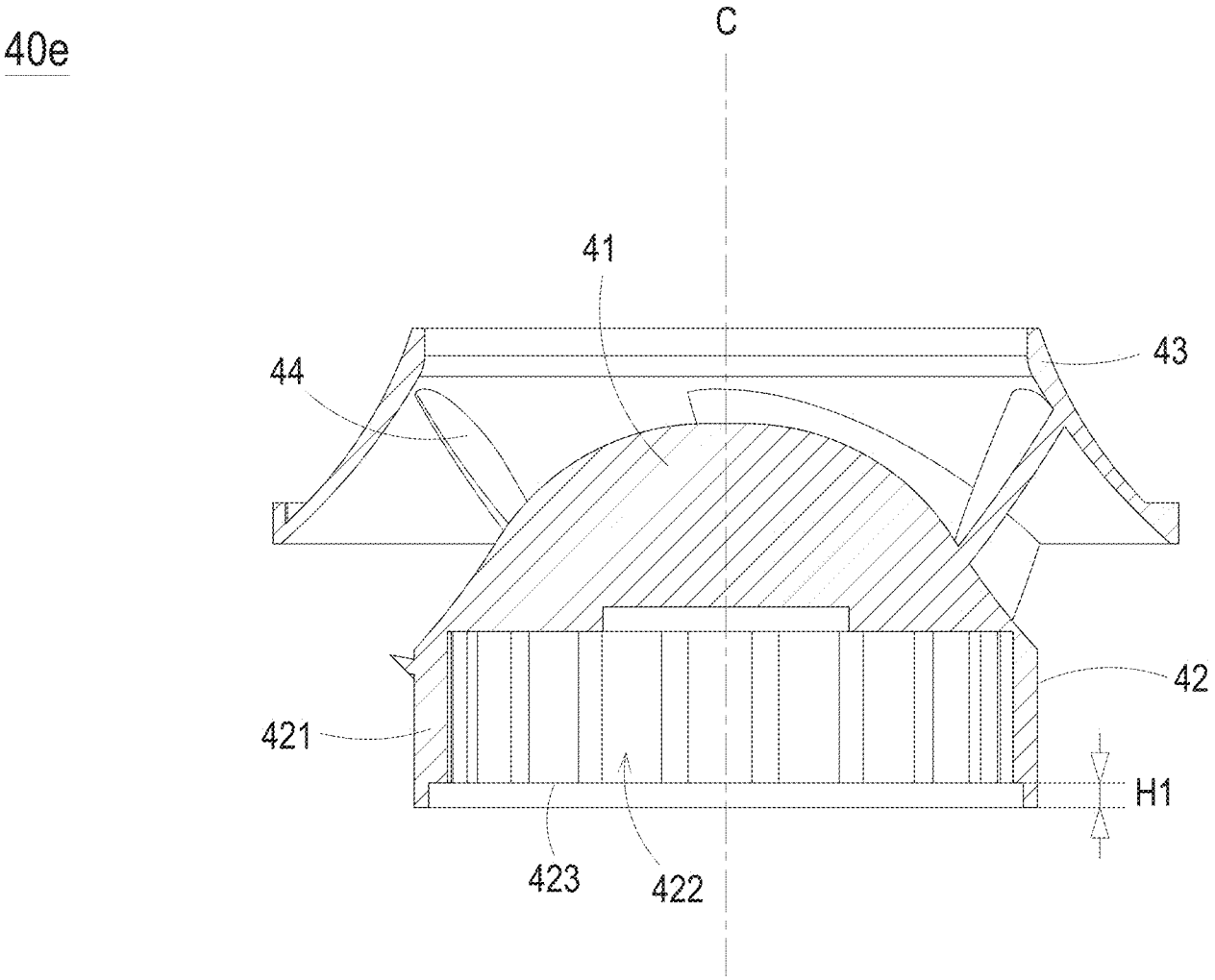
FIG. 19B is a cross-section view illustrating the impeller according to the sixth embodiment of the present disclosure.

FIG. 19B is a cross-section view illustrating the impeller according to the sixth embodiment of the present disclosure. In the embodiment, the plurality of protrusion portions 421 and the plurality of indentation portions 422 are elongated on the inner surface of the cylindrical part 42 along a direction parallel to the axial direction C. The upper ends of each of the plurality of protrusion portions 421 and each of the plurality of indentation portions 422 are at the upper edge of the cylindrical part 42, and the lower ends thereof which form the lower surface 423 are at a distance H1 away from the lower edge of the cylindrical part 42. That is, a lower circular portion, which has a height of H1, of the inner surface of the cylindrical part 42 is not occupied by the plurality of protrusion portions 421 and the plurality of indentation portions 422. Preferably but not exclusively, the lower surface 423 is perpendicular to the axial direction C, and the distance H1 is adjustable according to the practical requirements.

Figure 20:
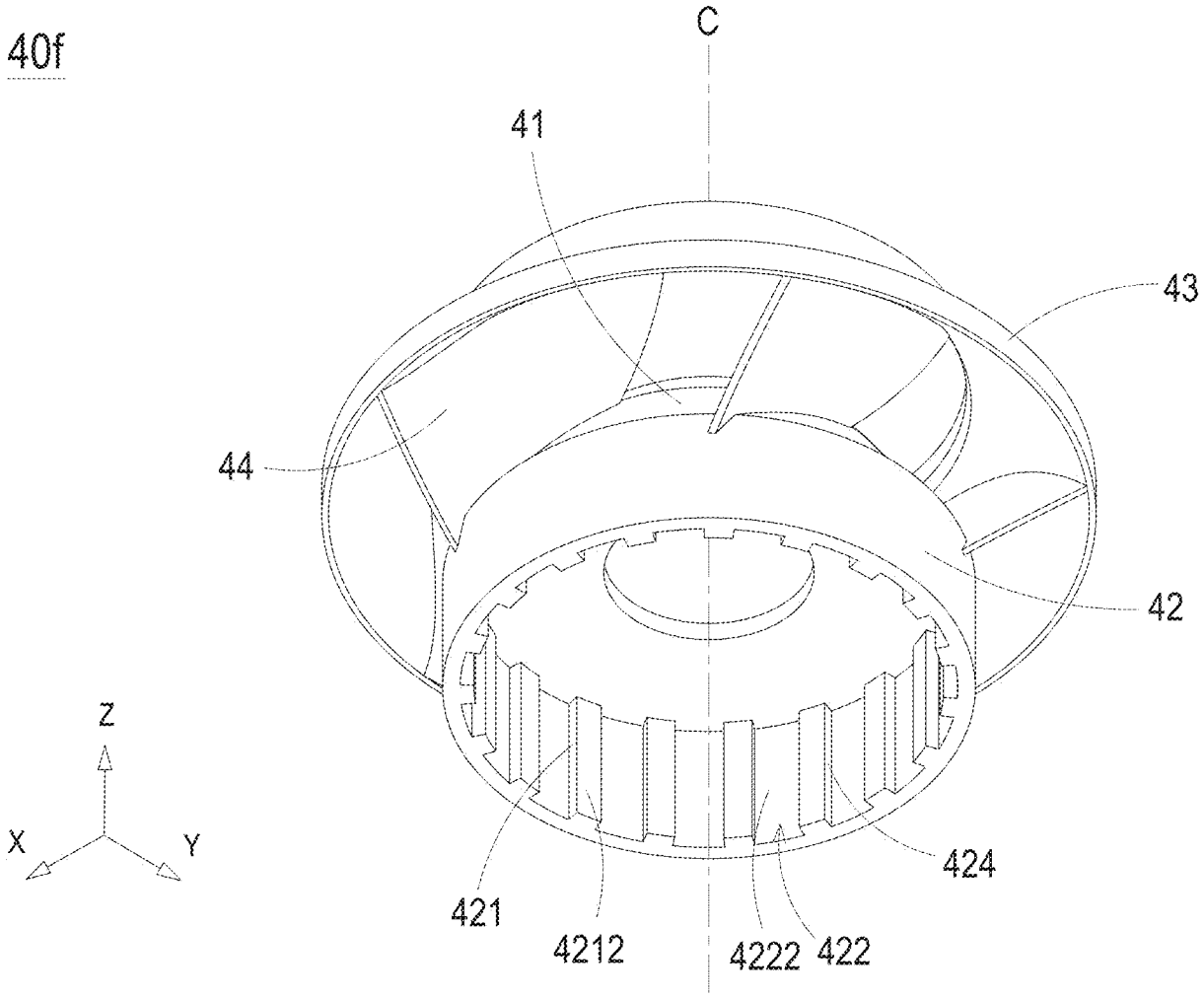
FIG. 20 is a perspective view illustrating an impeller shell according to a seventh embodiment of the present disclosure from a lower perspective.

FIG. 20 is a perspective view illustrating an impeller shell according to a seventh embodiment of the present disclosure from a lower perspective. In the embodiment, the impeller 40*f* includes a hub 41, a cylindrical part 42, a conical section shell 43, and a plurality of blades 44. The cylindrical part 42 includes a plurality of protrusion portions 421 and a plurality of indentation portions 422 disposed on an inner surface thereof. The plurality of protrusion portions 421 and the plurality of indentation portions 422 are elongated from the upper edge to the lower edge of the cylindrical part 42 along a direction parallel to the axial direction C, and are symmetrically arranged about the axial direction C in an alternate manner. In this embodiment, each of the plurality of protrusion portions 421 is configured to have a first surface 4212 facing the axial direction C and elongated from an upper end to a lower end thereof, and a circular connection surface of the first surfaces 4212 and the inner surface of the cylindrical part 42 are coaxial. Each of the plurality indentation portions 422 is configured to have a second surface 4222 facing the axial direction C and elongated from an upper end to a lower end thereof, and a circular connection surface of the second surfaces 4222 and the inner surface of the cylindrical part 42 are coaxial. More specifically, a distance from the axial direction C to the first surface 4212 is smaller than a distance from the axial direction C to the second surface 4222, and the first surface 4212 and the second surface 4222 are parallel to each other. Furthermore, a third surface 424 is provided to connect the first surface 4212 of one of the protrusion portions 421 to the second surface 4222 of an adjacent indentation portion 422, so the plurality of protrusion portions 421 form a plurality of step-shaped protrusions on the inner surface of the cylindrical part 42.

Figure 21A:
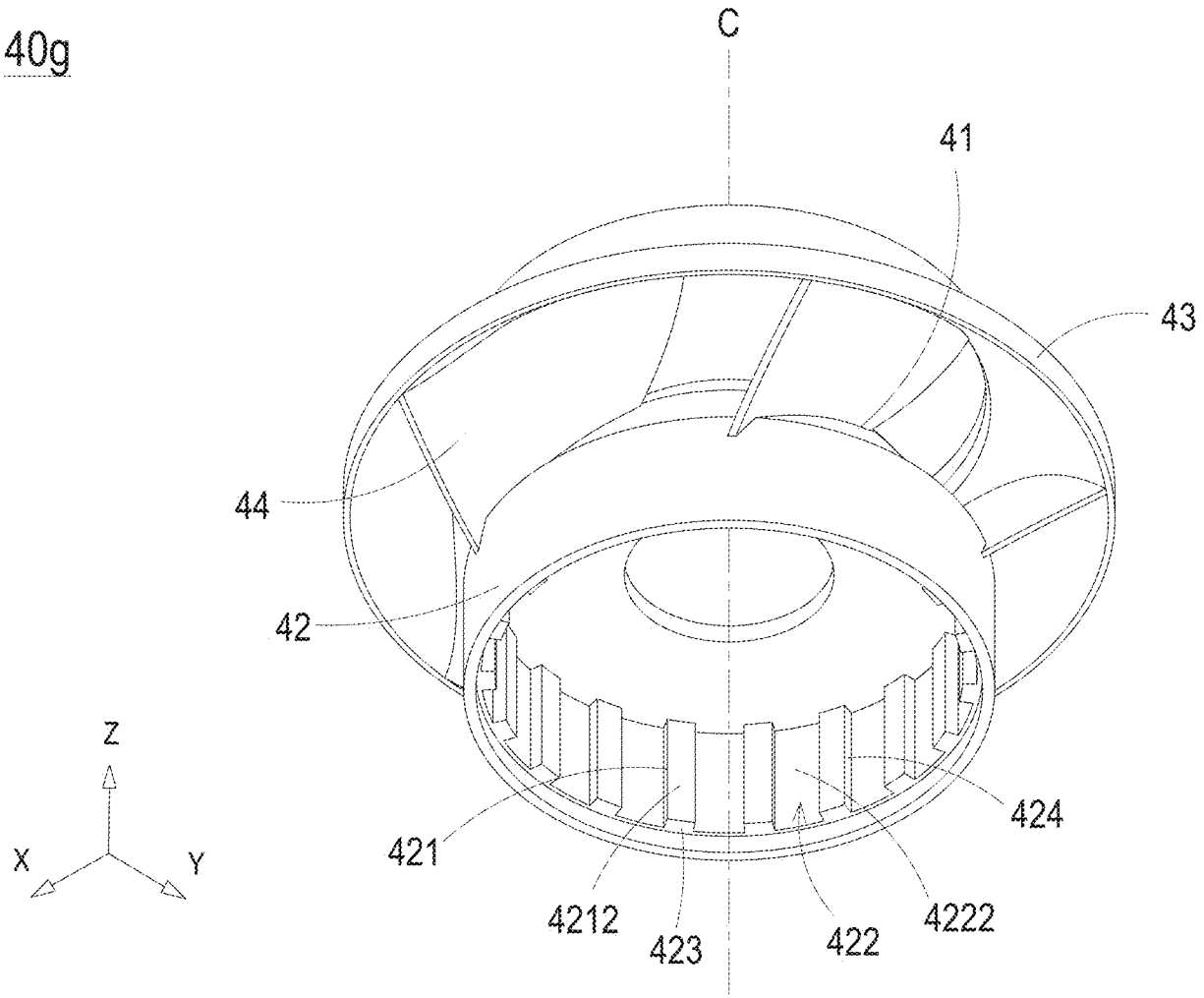
FIG. 21A is a perspective view illustrating an impeller shell according to an eighth embodiment of the present disclosure from a lower perspective.

FIG. 21A is a perspective view illustrating an impeller shell according to an eighth embodiment of the present disclosure from a lower perspective. In the embodiment, the structures, elements and functions of the impeller 40*g* are similar to those of the impeller 40*f* of FIG. 20, and are not redundantly described herein. In the embodiment, a plurality of protrusion portions 421 and a plurality indentation portions 422 are disposed on the inner surface of the cylindrical part 42 of the impeller 40*g*, elongated along a direction parallel to the axial direction C, and symmetrically arranged about the axial direction C in an alternate manner. Each of the plurality of protrusion portions 421 is configured to have a first surface 4212 facing the axial direction C and elongated from an upper end to a lower end thereof, and each of the plurality indentation portions 422 is configured to have a second surface 4222 facing the axial direction C and elongated from an upper end to a lower end thereof. A distance from the axial direction C to the first surface 4212 is smaller than a distance from the axial direction C to the second surface 4222, and the first surface 4212 and the second surface 4222 are parallel to each other. Moreover, a third surface 424 is provided to connect the first surface 4212 of one of the protrusion portions 421 to the second surface 4222 of an adjacent indentation portion 422, so the plurality of protrusion portions 421 form a plurality of step-shaped protrusions on the inner surface of the cylindrical part 42. Furthermore, the plurality of protrusion portions 421 and the plurality of indentation portions 422 include a lower surface 423 at a position higher than the lower edge of the cylindrical part 42.

Figure 21B:
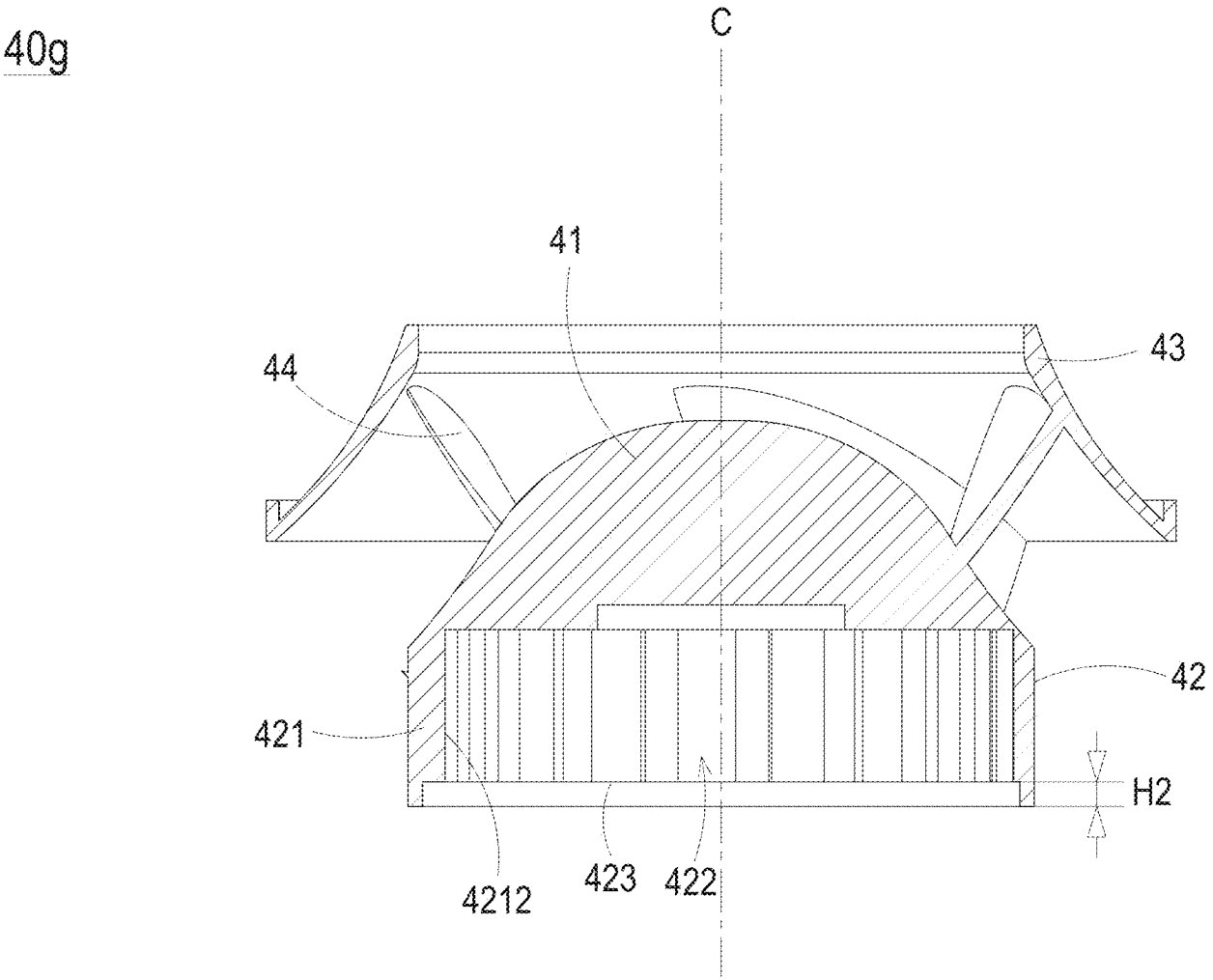
FIG. 21B is a cross-section view illustrating the impeller according to the eighth embodiment of the present disclosure.

FIG. 21B is a cross-section view illustrating the impeller according to the eighth embodiment of the present disclosure. In the embodiment, the plurality of protrusion portions 421 and the plurality of indentation portions 422 are elongated on the inner surface of the cylindrical part 42 along a direction parallel to the axial direction C. The upper ends of each of the plurality of protrusion portions 421 and each of the plurality of indentation portions 422 are at the upper edge of the cylindrical part 42, and the lower ends thereof which form the lower surface 423 are at a distance H2 away from the lower edge of the cylindrical part 42. That is, a lower circular portion, which has a height of H2, of the inner surface of the cylindrical part 42 is not occupied by the plurality of protrusion portions 421 and the plurality of indentation portions 422. Preferably but not exclusively, the lower surface 423 is perpendicular to the axial direction C, and the distance H2 is adjustable according to the practical requirements.

Figure 22:
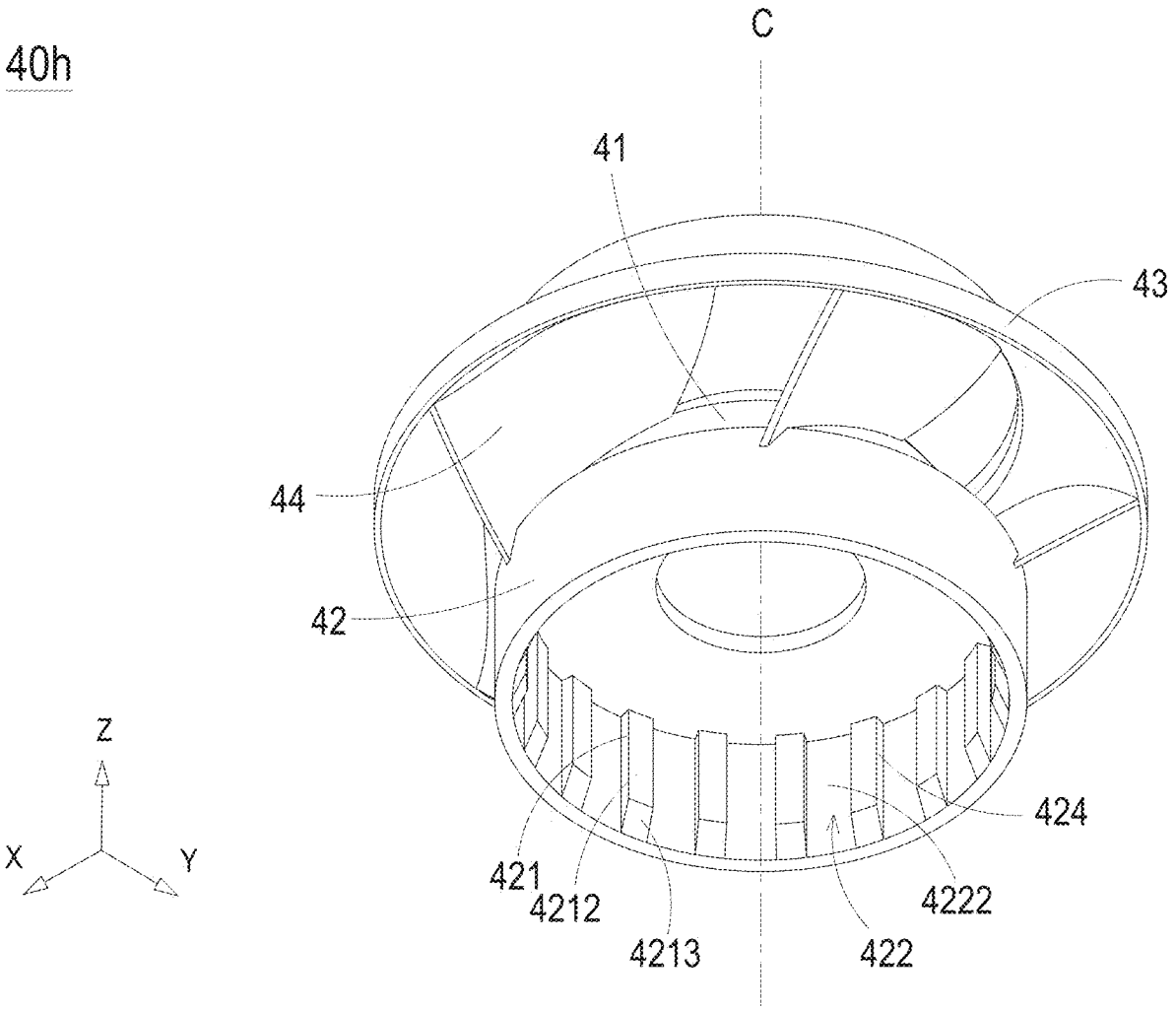
FIG. 22 is a perspective view illustrating an impeller shell according to a ninth embodiment of the present disclosure from a lower perspective.

FIG. 22 is a perspective view illustrating an impeller shell according to a ninth embodiment of the present disclosure from a lower perspective. In the embodiment, the structures, elements and functions of the impeller 40*h* are similar to those of the impeller 40*f* of FIG. 20, and are not redundantly described herein. In the embodiment, a plurality of protrusion portions 421 and a plurality of indentation portions 422 are elongated from the upper edge to the lower edge of the cylindrical part 42 along a direction parallel to the axial direction C, and are symmetrically arranged about the axial direction C in an alternate manner. Each of the plurality of protrusion portions 421 is configured to have a first surface 4212 facing the axial direction C and elongated from an upper end to a lower end thereof, and each of the plurality indentation portions 422 is configured to have a second surface 4222 facing the axial direction C and elongated from an upper end to a lower end thereof. A distance from the axial direction C to the first surface 4212 is smaller than a distance from the axial direction C to the second surface 4222, and the first surface 4212 and the second surface 4222 are parallel to each other. Moreover, a third surface 424 is provided to connect the first surface 4212 of one of the plurality of protrusion portions 421 to the second surface 4222 of an adjacent indentation portion 422, so the plurality of protrusion portions 421 form a plurality of step-shaped protrusions on the inner surface of the cylindrical part 42. Furthermore, a lower edge of the first surface 4212 is at a position higher than the lower edge of the cylindrical part 42 and higher than the lower edge of the second surface 4222, so as to form an inclined surface 4213 at the lower portion of each of the plurality of protrusion portions 421. The slope of the inclined surface 4213 is adjustable according to the practical requirements.

Figure 23A:
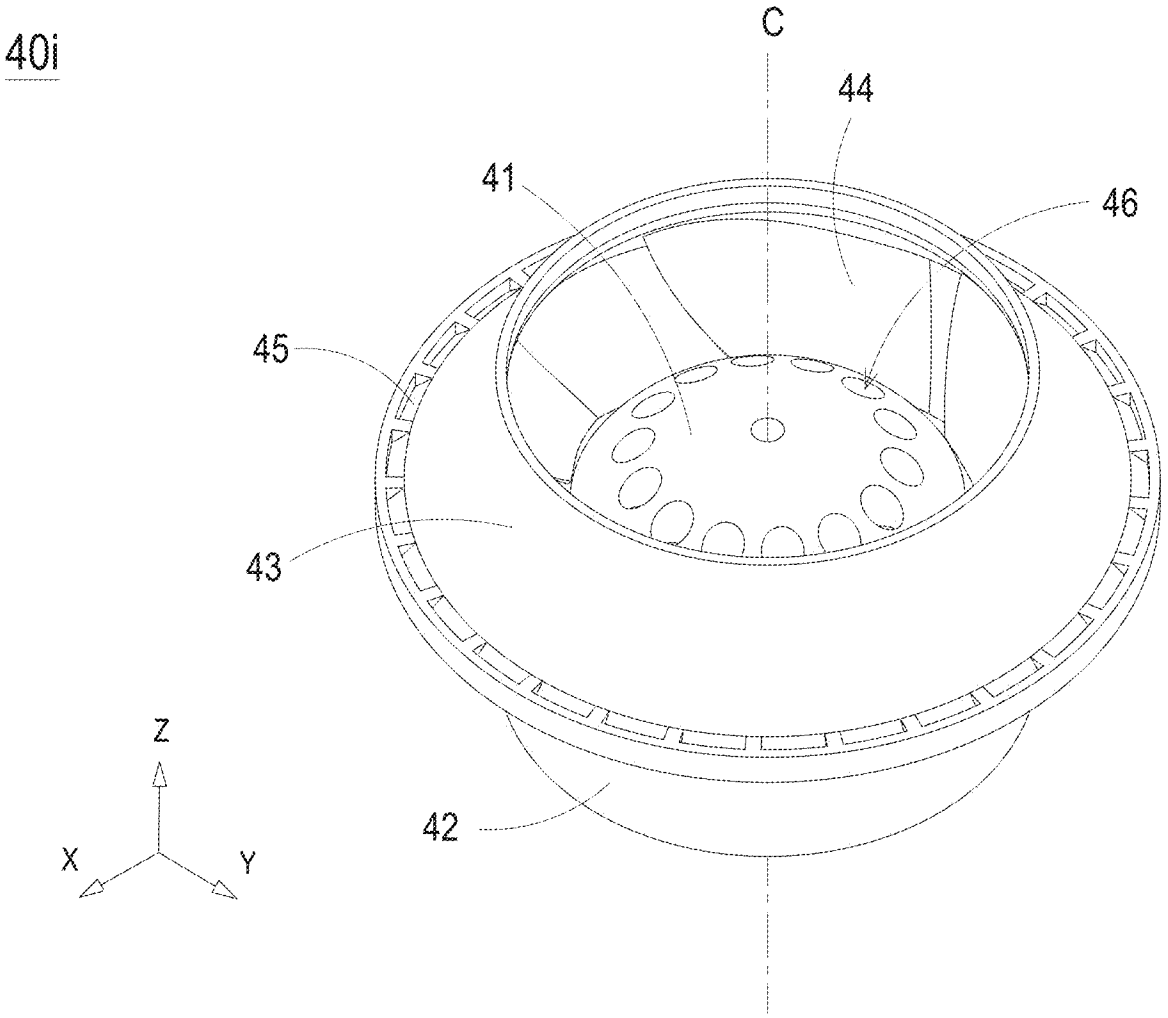
FIG. 23A is a perspective view illustrating an impeller according to a tenth embodiment of the present disclosure from an upper perspective.

FIG. 23A is a perspective view illustrating an impeller according to a tenth embodiment of the present disclosure from an upper perspective. In the embodiment, the structures, elements and functions of the impeller 40*i* are similar to those of the impeller 40*a* of FIG. 8A and FIG. 8B, and are not redundantly described herein. The impeller 40*i* includes a hub 41, a cylindrical part 42, a conical section shell 43, a plurality of blades 44, a plurality of balance holes 45 and a plurality of recesses 46. The plurality of depression 46 are disposed on the hub 41 and arranged symmetrically about the axial direction C, such as arranged in a circle shape.

Figure 23B:
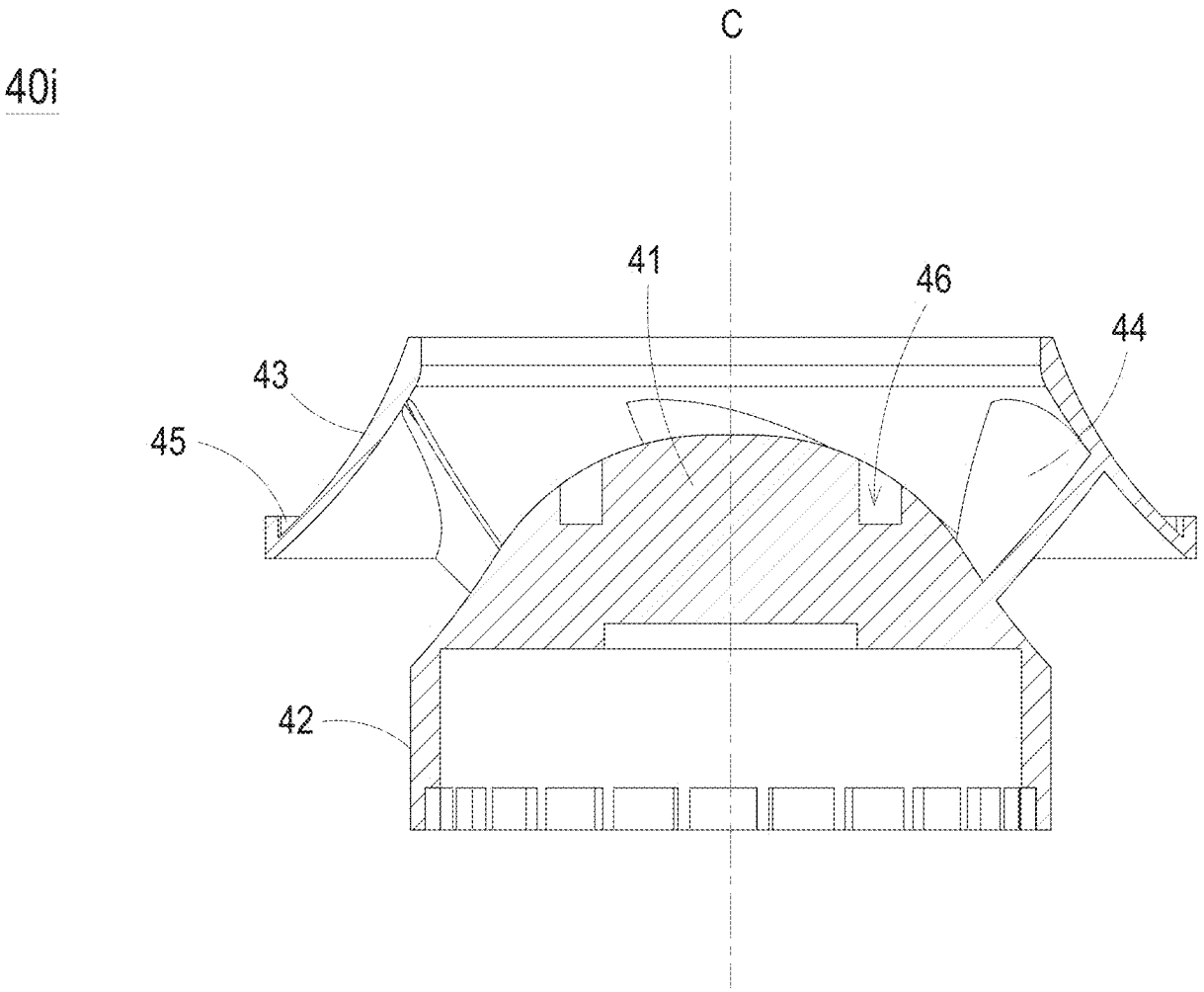
FIG. 23B is a cross-section view illustrating the impeller according to the tenth embodiment of the present disclosure.

FIG. 23B is a cross-section view illustrating the impeller according to the tenth embodiment of the present disclosure. In the embodiment, the outer diameter of the hub 41 of the impeller 40*i* is expended gradually in a direction from the conical section shell 43 toward the cylindrical part 42, and the plurality of recesses 46 are formed in the hub 41 without penetrating the hub 41. Preferably but not exclusively, the depression 46 is configured to have a cylindrical shape with a flat bottom surface. The formation of the plurality of recesses 46 also assists in adjusting the balance of the diagonal fan by filling balancing clay.

Figure 24A:
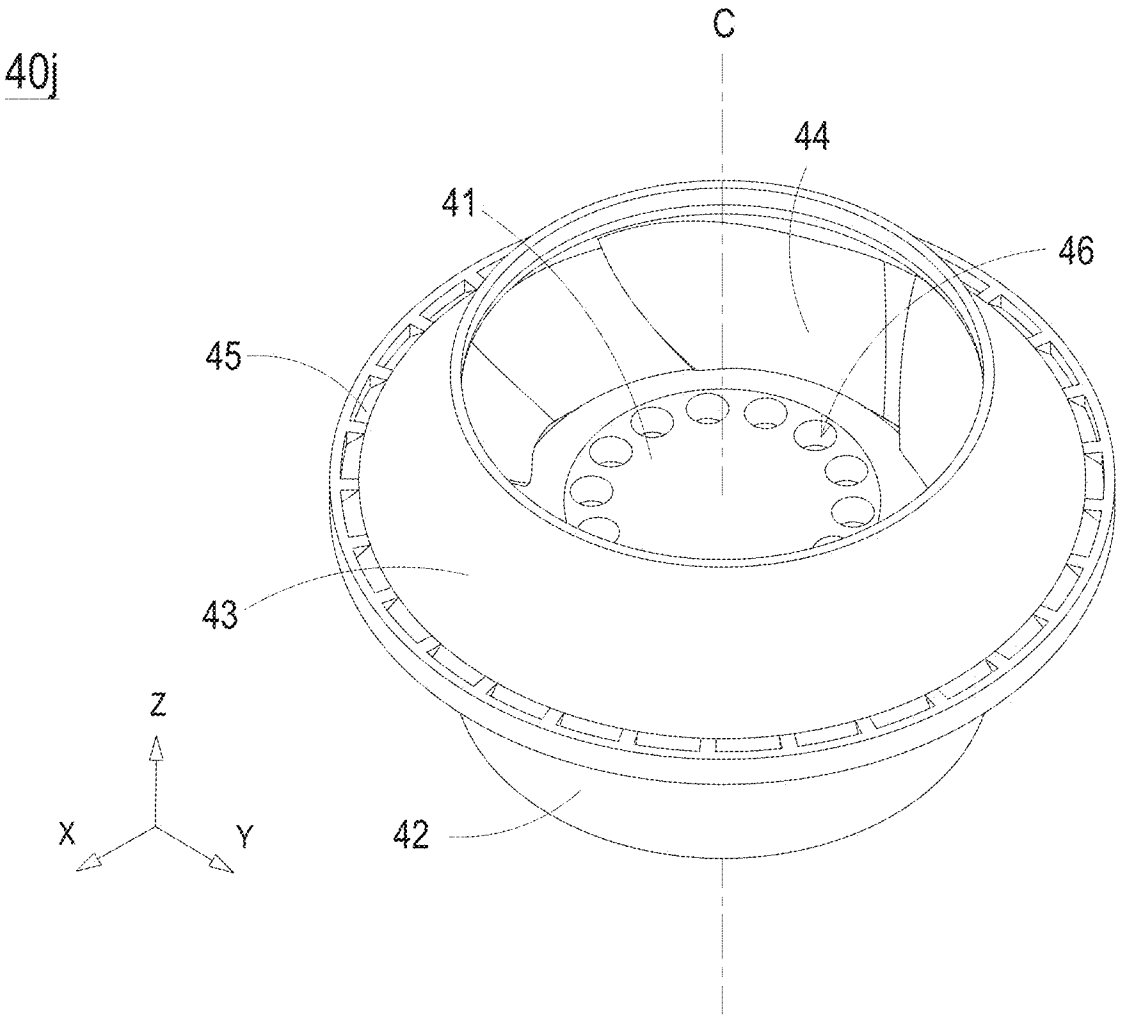
FIG. 24A is a perspective view illustrating an impeller according to an eleventh embodiment of the present disclosure from an upper perspective.

FIG. 24A is a perspective view illustrating an impeller according to an eleventh embodiment of the present disclosure from an upper perspective. In the embodiment, the structures, elements and functions of the impeller 40*j* are similar to those of the impeller 40*i* of FIG. 23A and FIG. 23B, and are not redundantly described herein. The impeller 40*j* includes a hub 41, a cylindrical part 42, a conical section shell 43, a plurality of blades 44, a plurality of balance holes 45 and a plurality of recesses 46. The plurality of depression 46 are disposed on the hub 41 and arranged symmetrically about the axial direction C, such as arranged in a circle shape. In other embodiments, the shapes and the arrangement of the recesses 46 are adjustable according to the practical requirements.

Figure 24B:
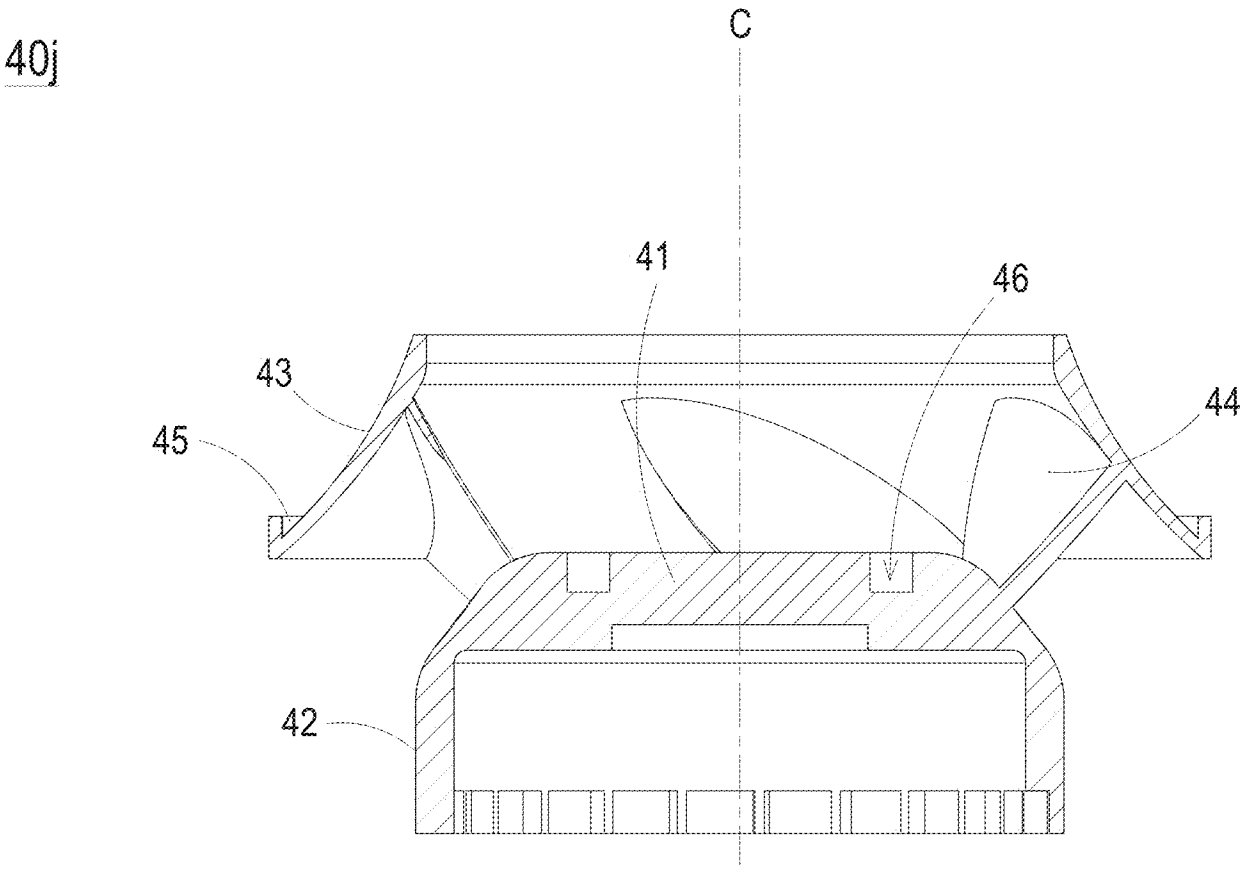
FIG. 24B is a cross-section view illustrating the impeller according to the eleventh embodiment of the present disclosure.

FIG. 24B is a cross-section view illustrating the impeller according to the eleventh embodiment of the present disclosure. In the embodiment, the upper end of the hub 41 includes a flat plane, and the plurality of recesses 46 are formed in the hub and under the flat plane without penetrating the hub 41. Preferably but not exclusively, the depression 46 is configured to have a cylindrical shape with a flat bottom surface. In other embodiments, the shapes and the arrangement of the recesses 46 are adjustable according to the practical requirements.

In summary, the present disclosure provides a diagonal fan having an optimized chamber to reduce the backflow flowing into the chamber and eliminate the turbulence area in the chamber and an improved impeller, thereby achieving the purpose of improving the fan characteristics and reducing the noise. The guiding wall disposed on the frame is staggered and overlapped with the upper end of the conical section shell of the impeller, the inlet diameter is less than the outlet diameter, and the upper end of the conical section shell is extended upwardly from the tips of the blades, so that the diagonal fan is allowed to achieve the characteristic of slowing down the stall region as a centrifugal fan. The inner wall surface of the frame and the outer wall and the upper end of the conical section shell are designed to be parallel to each other, and a gap having a spacing distance is substantially maintained between the inner wall surface of the frame, and the outer wall and the upper end of the conical section shell to form a backflow channel, so that as a backflow is sucked into the backflow channel through an intake section, the flow velocity and the kinetic energy of the flow field are reduced gradually. Therefore, the wind resistance between the inner wall surface of the frame, and the outer wall and the upper end of the conical section shell is increased, the backflow sucked into the backflow channel is reduced, and the turbulent flow intensity of the backflow channel is eliminated simultaneously. On the other hand, when the impeller is rotated, the backflow flows in the exhaust section along a direction identical to that of the airflow flowing. In this way, when the backflow is converged into the airflow, the collision of flowing field is less likely to occur and the noise during operation is reduced.

Moreover, through disposing the protrusion portions and the indentation portions on the inner surface of the cylindrical part, trenches can be formed between the impeller and the magnetic shell for providing spaces for overflowing the adhesive material as fixing the impeller with the magnetic shell and also facilitating the balance of the diagonal fan. Furthermore, the recesses disposed on the hub of the impeller are also provided for further assisting the balance of the diagonal fan.

While the disclosure has been described in terms of what is presently considered to be the most practical and preferred embodiments, it is to be understood that the disclosure needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A diagonal fan, comprising:

a frame comprising an inlet, an outlet, an accommodation space and a guiding wall, wherein the inlet and the outlet are disposed at two opposite sides of the frame, respectively, and in fluid communication with each other through the accommodation space; and an impeller accommodated within the accommodation space of the frame and comprising a hub, a cylindrical part, a conical section shell and a plurality of blades, wherein the cylindrical part is configured to accommodate a rotor, wherein the cylindrical part comprises a plurality of protrusion portions and a plurality of indentation portions disposed on an inner surface thereof, and the plurality of protrusion portions are abutted against an outer surface of a magnetic shell of the rotor;

wherein a gap having a spacing distance is substantially maintained between an inner wall surface of the frame, and an outer wall and an upper end of the conical section shell to form a backflow channel, and the backflow channel comprises an intake section, a horizontal section and an exhaust section; and wherein the conical section shell comprises a plurality of balance holes disposed around the lower end of the conical section shell, the horizontal section is spatially corresponding to the plurality of balance holes, and the backflow channel further comprises a second horizontal section spatially corresponding to the upper end of the conical section shell.

2. The diagonal fan according to claim 1, wherein the plurality of protrusion portions and the plurality of indentation portions are elongated along a direction parallel to an axial direction of the impeller and symmetrically arranged about the axial direction in an alternate manner.

3. The diagonal fan according to claim 2, wherein each of the plurality of indentation portions comprises a concave surface facing the axial direction and elongated from an upper end to a lower end thereof, and each of the plurality of protrusion portions comprises a flat surface connecting two adjacent concave surfaces of adjacent two of the plurality of indentation portions.

4. The diagonal fan according to claim 2, wherein each of the plurality of protrusion portions comprises a first surface facing the axial direction and elongated from an upper end to a lower end thereof, each of the plurality indentation portions comprises a second surface facing the axial direction and elongated from an upper end to a lower end thereof, and a third surface connects the first surface of one of the plurality of protrusion portions to the second surface of an adjacent one of the plurality of indentation portions, so the plurality of protrusion portions form a plurality of step-shaped protrusions on the inner surface of the cylindrical part.

5. The diagonal fan according to claim 4, wherein a lower edge of the first surface is at a position higher than a lower edge of the cylindrical part and higher than a lower edge of the second surface, so as to form an inclined surface at a lower portion of each of the plurality of protrusion portions.

6. The diagonal fan according to claim 1, wherein the plurality of protrusion portions and the plurality of indentation portions are elongated from an upper edge of the cylindrical part to a lower edge of the cylindrical part along a direction parallel to an axial direction of the impeller.

7. The diagonal fan according to claim 1, wherein upper ends of each of the plurality of protrusion portions and each of the plurality of indentation portions are at an upper edge of the cylindrical part, and lower ends of each of the plurality of protrusion portions and each of the plurality of indentation portions are at a distance away from a lower edge of the cylindrical part.

8. The diagonal fan according to claim 7, wherein the lower ends of each of the plurality of protrusion portions and each of the plurality of indentation portions form a lower surface perpendicular to an axial direction of the impeller.

9. The diagonal fan according to claim 1, wherein the hub of the impeller comprises a plurality of recesses disposed thereon and arranged symmetrically about an axial direction of the impeller.

10. The diagonal fan according to claim 1, wherein an outer diameter of the hub of the impeller is expended gradually in a direction from the inlet toward the outlet.

11. The diagonal fan according to claim 1, wherein an upper end of the hub of the impeller comprises a flat plane.

12. The diagonal fan according to claim 1, wherein the intake section is located adjacent to a lower end of the conical section shell and in fluid communication with the exhaust section through the horizontal section, and the upper end of the conical section shell is at least partially shielded by the guiding wall to form the exhaust section, wherein when an airflow flows from the inlet to the outlet, a backflow is transported from the intake section, flows through the horizontal section, is exhausted out through the exhaust section, and is converged with the airflow.

13. The diagonal fan according to claim 1, wherein the cylindrical part is configured to accommodate the rotor and a stator, the hub is disposed on the cylindrical part, the plurality of blade are spaced apart and disposed on the hub, and the plurality of blades are connected between the hub and the conical section shell, wherein when the impeller is rotated, an airflow is formed to flow through the plurality of blades and between the hub and the conical section shell.

* * * * *